US007113906B2

(12) United States Patent
Ohtake et al.

(10) Patent No.: US 7,113,906 B2
(45) Date of Patent: Sep. 26, 2006

(54) TRANSMISSION-RECEPTION SYSTEM, TRANSMISSION APPARATUS, RECEPTION APPARATUS AND TRANSMISSION-RECEPTION METHOD

(75) Inventors: Noboru Ohtake, Tokyo (JP); Yoshinori Shimizu, Tokyo (JP); Kosuke Misono, Kanagawa (JP)

(73) Assignee: Sony Corporation, Tokyo (JP)

( * ) Notice: Subject to any disclaimer, the term of this patent is extended or adjusted under 35 U.S.C. 154(b) by 1077 days.

(21) Appl. No.: 09/973,402

(22) Filed: Oct. 9, 2001

(65) Prior Publication Data

US 2002/0059061 A1 May 16, 2002

(30) Foreign Application Priority Data

Oct. 10, 2000 (JP) ..... 2000-308983

(51) Int. Cl.
*G10L 21/00* (2006.01)

(52) U.S. Cl. ..... 704/201; 386/96

(58) Field of Classification Search ..... 704/201, 704/500, 503; 386/96
See application file for complete search history.

(56) References Cited

U.S. PATENT DOCUMENTS 6,560,651 B1 * 5/2003 Katz et al. ..... 709/229
6,738,561 B1 * 5/2004 Tanaka et al. ..... 386/96
2001/0017975 A1 * 8/2001 Ando et al. ..... 386/96
2001/0024447 A1 * 9/2001 Yoshio et al. ..... 370/421

* cited by examiner

*Primary Examiner*—Daniel Abebe
(74) *Attorney, Agent, or Firm*—Frommer Lawrence & Haug LLP; William S. Frommer; Thomas F. Presson

(57) ABSTRACT

A transmission-reception system is disclosed wherein digital data whose miss cannot be admitted can be transmitted on the real time basis with certainty and accurately without imposing a high load to any of electronic equipments on the transmission side and the reception side. DMCT data as ancillary data whose miss cannot be admitted are supplied from a DVD-Audio decoder of a DVD player to a microcomputer of a digital I/F section. The microcomputer supplies the DMCT data to a transmission data packet composite modulator of a link layer transmitter-receiver. The modulator divides the DMCT data into data units of an equal data length and adds a label and a sublabel to each of the data units to form a transmission data set. The sublabel indicates whether the corresponding data unit is the first data unit or a succeeding data set succeeding to the first data unit. The transmission data sets of the DMCT data formed by the modulator are transmitted.

27 Claims, 12 Drawing Sheets

| VALUE (HEXADECIMAL NOTATION) | EXPLANATION |
|---|---|
| 00h-3Fh | IEC60958 CONFORMANT |
| 40h-4Fh | MULTI-BIT LINEAR AUDIO |
| 50h-57h | ONE-BIT AUDIO (Plain) |
| 58h-5Fh | ONE-BIT AUDIO (Encoded) |
| 60h-7Fh | -reserved- |
| 80h-83h | MIDI CONFORMANT |
| 84h-87h | -reserved- FOR SOUND DATA EXTENSION |
| 88h-8Bh | SMPTE TIME CODE CONFORMANT |
| 8Ch-8Fh | SAMPLE COUNT |
| 90h-BFh | -reserved- |
| C0h-EFh | ANCILLARY DATA |
| F0h-FFh | -reserved- |

| VALUE (HEXADECIMAL NOTATION) | DEFINITION |
|---|---|
| C0h-CFh | COMMON ANCILLARY DATA |
| D0h-EFh | APPLICATION SPECIFIC ANCILLARY DATA |

| | |
|---|---|
| CFh | NO ANCILLARY DATA |
| D0h | ANCILLARY DATA FOR DVD-AUDIO |
| D1h | ANCILLARY DATA FOR SACD |

FIG. 7

EXPLANATION OF SUBLABEL

| VALUE | EXPLANATION |
|---|---|
| 00000000 | NOT USED |
| 00000001 | ANCILLARY DATA TO BE TRANSMITTED AT EVERY DATA BLOCK |
| 00000010 | ANCILLARY DATA TO BE TRANSMITTED BEFORE STARTING OF PLAYBACK |
| 00000011 | SUM TOTAL OF TABLE PARITY AND DMCT AND END OF DMCT |
| 00000100 | START DATA OF DMCT |
| 00000101 | CONTINUATION DATA OF DMCT |

TRANSMISSION-RECEPTION SYSTEM, TRANSMISSION APPARATUS, RECEPTION APPARATUS AND TRANSMISSION-RECEPTION METHOD

BACKGROUND OF THE INVENTION

This invention relates to a transmission-reception system which includes a transmission apparatus and a reception apparatus for transmitting and receiving data such as, for example, digital audio data, respectively, and a transmission apparatus, a reception apparatus and a transmission-reception method for use with the transmission-reception system.

Audio data in the form of digital data such as, for example, music data (tune data) are provided in the form of a recording medium such as a CD (Compact Disc) or an MD (Mini Disc) on which the audio data are recorded, or provided through a communication network. In recent years, audio data digitized in a format (standards) of a new category which does not belong to conventional categories are provided.

For example, audio data compatible with the DVD-Audio standards or the SACD standards are provided. The DVD is an abbreviation of Digital Versatile Disc, and the SACD is an abbreviation of Super Audio Compact Disc.

Audio data produced in accordance with the DVD-Audio standards or the SACD standards have a frequency characteristic of 100,000 Hz (Hertz) and a dynamic range of 140 dB (decibel) in the maximum. Since a conventional CD has a frequency characteristic of up to 20,000 Hz and a dynamic range of 96 dB, audio data can be provided with a very high performance through the employment of the DVD-Audio standards or the SACD standards.

The DVD-Audio standards adopt a multi-channel system so that a maker of audio data (audio information) can use, for example, an arbitrary number of channels from the channel 1 to the channel 6 to record produced audio data onto a DVD. Thus, the user can play back and enjoy sound full of presence from the DVD in a home theater or the like.

When digital audio data are transmitted between electronic equipments, taking an influence of noise in the transmission process and so forth into consideration, the digital audio data are preferably transmitted in the form of digital data without converting them into an analog signal. Therefore, also audio data provided in accordance with new standards such as the DVD-Audio standards are transmitted between electronic equipments along a digital bus.

In order to transmit digital audio data between electronic equipments connected to each other by a digital bus in this manner, the audio data to be transmitted are sectioned (divided) into units for transmission of a predetermined size, and to each of the divisional transmission units of the data, a label representative of what standards are used to produce the digital data is added. Then, the resulting data of the divisional transmission units are transmitted on the real time basis.

In the real time transmission, an equipment on the reception side receives data transmitted thereto in synchronism with the progress of transmission of data from an electronic equipment of the transmission side As described above, in the real time transmission, digital data are transmitted with a label applied thereto which indicates what standards are used to produce the digital data so that an electronic equipment of the reception side can recognize the standards for the digital data and perform suitable processing in accordance with the standards to play back the received audio data.

When it is intended to transmit main information data which are a main subject of transmission such as, for example, digital audio data on the real time basis between electronic equipments connected to each other by a digital bus, it is sometimes necessary to transmit ancillary data to the equipment of the reception side in addition to the main information data.

For example, in transmission of linear PCM audio data in accordance with the DVD-Audio standards described above, it is necessary to transmit ancillary data for allowing an equipment of the reception side to process multi-channel audio data based on the number channels of the equipment of the reception side and process the received audio data in accordance with the DVD-Audio standards to play back sound in a form estimated in advance.

The ancillary data cannot be transmitted through a single transmission process as data of a predetermined transmission unit. Accordingly, in order to transmit all ancillary data, the ancillary data must be divided and transmitted by a plural number of times for each predetermined transmission data unit. However, it is considered that, where ancillary data are transmitted by a plural number of times for each predetermined transmission data unit, a miss of some ancillary data may possibly occur.

Even if a miss of some data occurs with main information data such as audio data, this may be admitted (permitted) in the transmission process if one of various interpolation techniques is used. However, since ancillary data individually have important significance and replacement of any of them with some other data disables normal playback processing, such an interpolation technique as can be applied to audio data cannot be applied to ancillary data. Accordingly, it matters to recognize individual ancillary data of a predetermined transmission unit and assure the sequence property of the ancillary data.

To this end, it is a possible idea that an asynchronous communication system such as asynchronous communication which is used to transmit data whose miss is not permitted such as, for example, control data is used for a digital interface of the IEEE (Institute Electrical and Electronics Engineers) 1394 standards.

In particular, a reception equipment which receives data from a transmission equipment sends back a response representing the reception of the data to the transmission equipment, and when the response is received, the transmission equipment transmits next data, but when no response is received, the transmission equipment transmits the same data again so that all ancillary data may be transmitted with certainty. However, this countermeasure eliminates the real time property. On the other hand, it is cumbersome to transmit audio data and ancillary data in accordance with different transmission systems such that the audio data are transmitted on the real time basis in accordance with a synchronous communication system and the ancillary data are transmitted by asynchronous communication, and besides this increases the load to the transmission apparatus and also to the reception apparatus.

It is another possible idea to apply, for example, individually different sequenced labels to ancillary data divided into predetermined transmission units to be transmitted. This countermeasure, however, uses labels wastefully and decreases the extensibility of labels.

Further, if it is tried to apply different labels individually to ancillary data divided into predetermined transmission units, then an equipment on the transmission side must form a large number of different labels to be applied to the individual transmission units of the ancillary data and add the labels individually to the transmission units of the ancillary data. This applies a high load to the equipment of the transmission side.

Also the equipment of the reception side must recognize the ancillary data applied to the individual transmission units of the ancillary data and re-construct the ancillary data based on the recognized ancillary data. Therefore, the equipment of the reception side must use a complicated decoding circuit and a high load is imposed on the equipment of the reception side.

Therefore, it is demanded, in real time transmission of digital data whose amount is so large that they must be transmitted divisionally by a plural number of times but whose miss or drop cannot be admitted like such ancillary data as described above, to make it possible to transmit the digital data with certainty and accurately without using labels wastefully and without imposing a high load on any of electronic equipments of the transmission side and the reception side.

SUMMARY OF THE INVENTION

It is an object of the present invention to provide a transmission-reception system, a transmission apparatus, a reception apparatus and a transmission and reception method wherein digital data whose miss cannot be admitted can be transmitted on the real time basis with certainty and accurately without imposing a high load to any of electronic equipments on the transmission side and the reception side.

In order to attain the object described above, according to an aspect of the present invention, there is provided a transmission-reception system for transmitting and receiving digital data, which must be transmitted divisionally in a plural number of times and do not admit a miss thereof, on the real time basis, including a transmission apparatus including division means for dividing the digital data into a predetermined number of data units of an equal size, information addition means for adding, to that one of the transmission data units obtained by the division of the digital data by the division means which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit, and transmission means for transmitting the transmission data units to which the information is added by the information addition means on the real time basis, and a reception apparatus including reception means for receiving the data units transmitted on the real time basis from the transmission apparatus, and restoration means for positioning that one of the data units received by the reception means to which the information representing that the data unit is the first data unit as top data is added and positioning each of the data units received following the first data unit to which the information representing that the data unit is a succeeding data unit is added as succeeding data next to the last one of the data units which have been received till then.

In the transmission-reception system, the division means of the transmission apparatus divides digital data, which do not make sense on the reception side if all of them are not received accurately, that is, which do not permit any miss thereof, into a predetermined number of data units of an equal size.

Then, to that one of the transmission data units obtained by the division of the digital data by the division means which is to be transmitted first, information (a start data sublabel) representing that the transmission data unit is the first transmission data unit is added by the information addition means. Further, to each of those ones of the transmission data units which are to be successively transmitted following the first transmission data unit, information (a continuation data sublabel) representing that the transmission data unit is a succeeding transmission data unit is added by the information addition means. The transmission data units to which the information is added by the information addition means in this manner are transmitted on the real time basis by the transmission means.

The data units transmitted on the real time basis from the transmission apparatus in this manner are received by the reception means of the reception apparatus. Then, it is discriminated by the restoration means whether each of the data units of the digital data received from the transmission apparatus is a data unit to which the start data sublabel is added or a data unit to which the continuation data sublabel is added. The data unit to which the start data sublabel is added is positioned as top data whereas each of the data units to which the continuation data sublabel is added is positioned as succeeding data next to the last one of the data units which have been received till then irrespective of the reception condition then thereby to restore the digital data having been transmitted divisionally from the transmission apparatus.

Consequently, for example, when transmission of digital data is interrupted by some reason and then the transmission state is restored, the reception apparatus side can discriminate it without intervention of a higher order protocol which one of two choices expected by the transmission apparatus should be selected including a choice that data to be received by the reception apparatus can be continuously updated as they are and another choice that transmission of the data must be performed again from the beginning, and take a suitable countermeasure based on the discrimination.

The transmission-reception system may be configured such that the transmission apparatus further includes end data formation means for forming end data representative of the end of transmission of the digital data transmitted as the transmission data units and the transmission means transmits the end data from the end data formation means immediately after the last one of the transmission data units of the digital data to be transmitted is transmitted, and the reception apparatus includes discrimination means for discriminating whether or not the data of any of the data units received by the reception means are the end data.

In the transmission-reception system, end data formed by the end data formation means are transmitted from the transmission apparatus through the transmission means immediately after the last one of the transmission data units of the digital data to be transmitted is transmitted. In the reception apparatus, the discrimination means discriminates whether or not the end data are received. Consequently, the reception apparatus can detect it with certainty whether or not all of the digital data to be transmitted divisionally from the transmission apparatus are received successfully.

In this instance, the transmission-reception system may be configured such that the transmission apparatus further includes transmission data sum total calculation means for calculating the sum total of the data of the data units divided by the division means and the end data formation means forms the end data which include the sum total calculated by the transmission data sum total calculation means, and the reception apparatus further includes receive data sum total calculation means for calculating the sum total of the received data received by the reception means and including the data of the data unit to which the information representing that the data unit is the first data unit is added and the data of the data units to each of which the information representing that the data unit is a succeeding data unit is added, and discrimination means for comparing the sum total of the received data calculated by the receive data sum total calculation means with the sum total of the data of the data units included in the end data to discriminate whether or not all of the digital data transmitted are received normally.

In the transmission-reception system, the transmission data sum total calculation means of the transmission apparatus calculates the sum total of the data of the data units (transmission data units) to be transmitted, and the thus calculated sum total of the data of the transmission data units is included into and transmitted together with the end data. In the reception apparatus, the receive data sum total calculation means calculates the sum total of the received data (receive data units). The discrimination means compares the calculated sum total of the data of the received data units with the sum total of the data of the received data units included in the received end data to discriminate whether or not all of the digital data transmitted are received normally.

By comparing the sum total of the transmitted divisional data and the sum total of the received divisional data with each other in this manner, it can be discriminated simply and accurately whether or not all of the divisional digital data are received normally.

The transmission-reception system may be configured such that the digital data to be transmitted are divided into a predetermined number of data units, and the reception apparatus includes counting means for counting the number of the data unit to which the information representing that the data unit is the first data unit is added and the data units to each of which the information representing that the data unit is a following data unit is applied.

In the transmission-reception system, since the data length of the digital data to be transmitted divisionally by a plural number of times is determined in advance and also the size of the transmission data units is determined in advance, also the dividing number of the digital data is determined in advance and can be recognized commonly by both of the transmission apparatus and the reception apparatus. Therefore, the counting means of the reception apparatus counts and manages the number of the received data units.

Since the number of the received data units is managed in this manner, the reception process of the data units of the digital data can be managed accurately, and it can be discriminated whether or not all of the data of the data units transmitted are received successfully without a miss.

The digital data may be text data.

In the transmission-reception system, text data can be transmitted as the digital data which do not permit a miss thereof. Consequently, when text data are transmitted divisionally, they can be transmitted with reliability without deterioration of the transmission efficiency.

The transmission-reception system may be configured such that main information data in the form of digital data can be transmitted between the transmission apparatus and the reception apparatus on the real time basis, and the digital data are duplication control information or copyright information regarding the main information data or ancillary data for allowing the reception apparatus to play back the main information data in accordance with a method or standards determined in advance.

In the transmission-reception apparatus, the digital data which do not permit a miss thereof are duplication control information or copyright information regarding main information data such as, for example, audio data or ancillary data for allowing the reception apparatus to play back the main information data in accordance with a method or standards determined in advance, and such duplication control information, copyright information or ancillary data are divided into and transmitted as a predetermined number of data units of an equal size.

Consequently, when duplication control information, copyright information or ancillary data are transmitted divisionally, they can be transmitted with reliability without deterioration of the transmission efficiency.

Alternatively, the transmission-reception system may be configured such that main information data in the form of digital data can be transmitted between the transmission apparatus and the reception apparatus, and the digital data are ancillary data for allowing the reception apparatus to play back multi-channel digital audio data as the main information data in accordance with a number of channels of the reception apparatus and in accordance with a method or standards determined in advance.

In the transmission-reception apparatus, the digital data which do not permit a miss thereof are ancillary data which are transmitted, for example, when multi-channel linear PCM audio data of the DVD-Audio standards are transmitted and represent coefficients and/or a calculation method to be used for down mix processing of audio data into a number of audio signals equal to the number of channels of the reception apparatus, and the ancillary data are transmitted divisionally in predetermined transmission data units.

Consequently, when ancillary data for down mix processing and so forth are transmitted divisionally, they can be transmitted with reliability without deterioration of the transmission efficiency.

According to another aspect of the present invention, there is provided a transmission apparatus, including division means for dividing digital data, which must be transmitted divisionally in a plural number of times and do not admit a miss thereof, into a predetermined number of data units of an equal size, information addition means for adding, to that one of the transmission data units obtained by the division of the digital data by the division means which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit, and transmission means for transmitting the transmission data units to which the information is added by the information addition means on the real time basis.

According to a further aspect of the present invention, there is provided a reception apparatus for receiving data successively transmitted thereto on the real time basis and including digital data, which must be transmitted divisionally in a plural number of times and do not admit a miss thereof, divided into a plurality of data units of an equal size, information added to that one of the data units which is transmitted first and representing that the data unit is the first data unit, and information added to each of those ones of the data units which are successively transmitted following the first data unit and representing that the data unit is a following data unit following the first data unit, including reception means for receiving the data units transmitted on the real time basis, and restoration means for positioning that one of the data units received by the reception means to which the information representing that the data unit is the first data unit as top data is added and positioning each of the data units received following the first data unit to which the information representing that the data unit is a succeeding data unit is added as succeeding data next to the last one of the data units which have been received till then.

According to a still further aspect of the present invention, there is provided a transmission-reception method for transmitting and receiving digital data, which must be transmitted divisionally in a plural number of times and do not admit a miss thereof, on the real time basis, including a division step performed by a transmission apparatus of dividing the digital data into a predetermined number of units of an equal size, an information addition step performed by the transmission apparatus of adding, to that one of the transmission data units obtained by the division of the digital data by the division step which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit, a transmission step performed by the transmission apparatus of transmitting the transmission data units to which the information is added by the information addition step on the real time basis, a reception step performed by a reception apparatus of receiving the data units transmitted on the real time basis from the transmission apparatus, and a restoration step performed by the reception apparatus of positioning that one of the data units received by the reception step to which the information representing that the data unit is the first data unit as top data is added and positioning each of the data units received following the first data unit to which the information representing that the data unit is a succeeding data unit is added as succeeding data next to the last one of the data units which have been received till then.

In summary, with the transmission-reception system, transmission apparatus, reception apparatus and transmission-reception method, where digital data are transmitted divisionally in a plural number of times without confirmation of transmission-reception between the transmission apparatus and the reception apparatus, when the transmission of digital data is interrupted by some reason and then the transmission state is restored, the reception apparatus side can discriminate it without intervention of a higher order protocol which one of two choices expected by the transmission apparatus should be selected including a choice that data to be received by the reception apparatus can continuously updated as they are and another choice that transmission of the data must be performed again from the beginning, and take a suitable countermeasure based on the discrimination.

Where end data representative of the end of transmission of the digital data to be transmitted divisionally in a plural number of times are transmitted immediately after the last one of the transmission data units of the digital data to be transmitted is transmitted, the reception apparatus can detect it with certainty whether or not all of the digital data to be transmitted divisionally from the transmission apparatus are received successfully.

Where the sum total of the digital data to be transmitted is included into and transmitted together with the end data, the reception apparatus can discriminate it rapidly and simply whether or not all of the digital data transmitted are received normally by comparing the sum total of the data of the transmitted data units and the sum total of the data of the received data units with each other.

Where the number of the received data units is managed, the reception process of the data units of the digital data can be managed accurately, and it can be discriminated whether or not all of the data of the data units transmitted are received successfully without a miss.

Also when text data, duplication prevention control information, copyright information or ancillary data for allowing main information data to be played back in accordance with a method or standards determined in advance are transmitted on the real time basis, such digital data which do not permit a miss thereof can be transmitted rapidly and accurately without increasing the load to the transmission apparatus or the reception apparatus.

BRIEF DESCRIPTION OF THE DRAWINGS

FIG. 7 is a table illustrating data used as a sublabel for ancillary data in the format illustrated in FIG. 5;

DETAILED DESCRIPTION OF THE PREFERRED EMBODIMENT

In the following, a transmission-reception system, a transmission apparatus, a reception apparatus and a transmission-reception method according to a preferred embodiment of the present invention are described with reference to the accompanying drawings. In the embodiment described below, audio data (digital audio data) recorded on a DVD in accordance with the DVD-Audio standards are transmitted over a digital bus of the IEEE 1394 standards.

Figure 1:
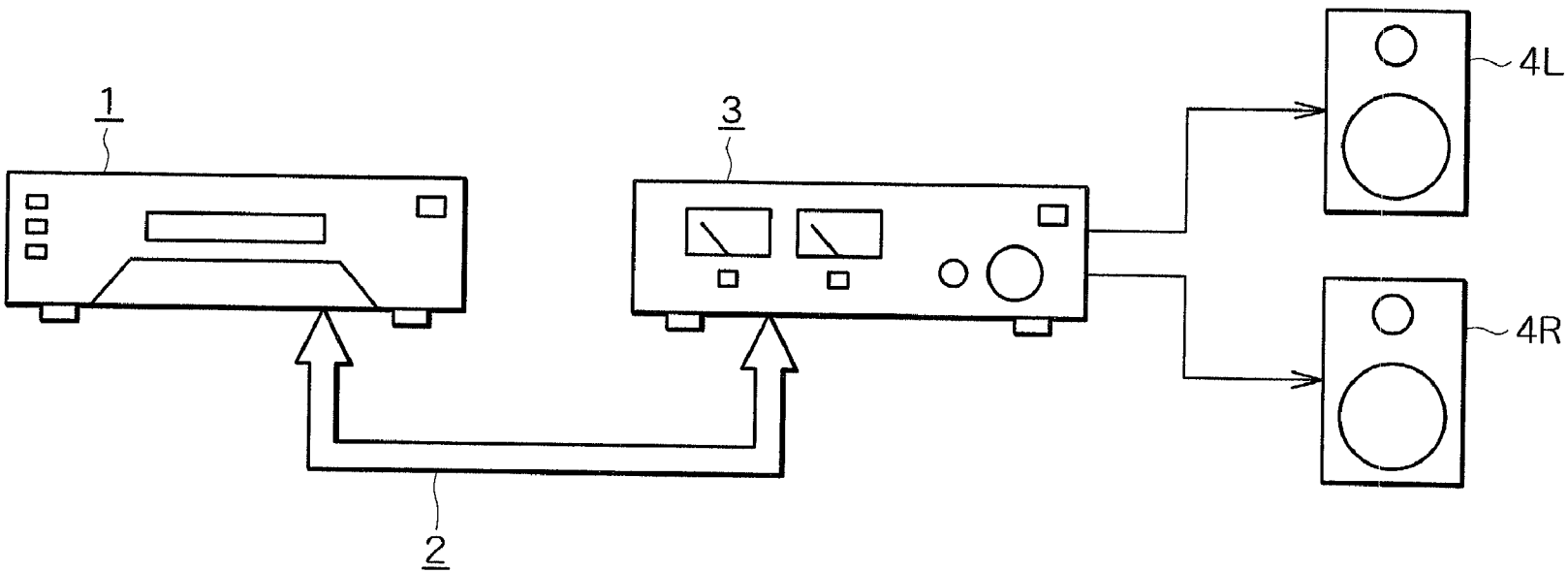
FIG. 1 is a schematic view of a transmission-reception system to which the present invention is applied.

Referring first to FIG. 1, the transmission-reception system according to the preferred embodiment of the present invention is generally shown. The transmission-reception system shown includes a DVD player 1 and an audio amplifier apparatus (hereinafter referred to merely as audio amplifier) 3 connected to each other by a digital bus 2 of the IEEE 1394 standards.

In the transmission-reception system, audio data read out from a DVD loaded in the DVD player 1 are supplied from the DVD player 1 to the audio amplifier 3 over the digital bus 2. The audio amplifier 3 forms analog audio signals for the two left and right channels from the audio data supplied thereto and supplies the analog audio signals to a pair of left and right speakers 4L and 4R, respectively. Consequently, sound based on the audio data read out from the DVD by the DVD player 1 are emitted from the left and right speakers 4L and 4R connected to the audio amplifier 3.

In the transmission-reception system, audio data recorded on a DVD are multi-channel audio data compliant with the DVD-Audio standards as described above. In other words, audio data supplied from the DVD player 1 to the audio amplifier 3 are multi-channel audio data of an arbitrary number of channels with regard to contents of the disk, for example, from one channel to 6 channels.

Accordingly, it is necessary for the audio amplifier 3 to perform down mix processing of changing multi-channel audio data into audio data of the two left and right channels. Therefore, the DVD player 1 supplies not only multi-channel audio data but also several necessary data such as DMCT data which are read out from the DVD and used to perform down mix processing in accordance with a method compliant with the DVD-Audio standards as ancillary data to the audio amplifier 3 over the digital bus 2.

The audio amplifier 3 receives supply of multi-channel audio data of the DVD-Audio standards and several necessary data such as DMCT data and performs down mix processing compliant with the DVD-Audio standards using the received ancillary data to form audio data of the two left and right channels.

Figure 2:
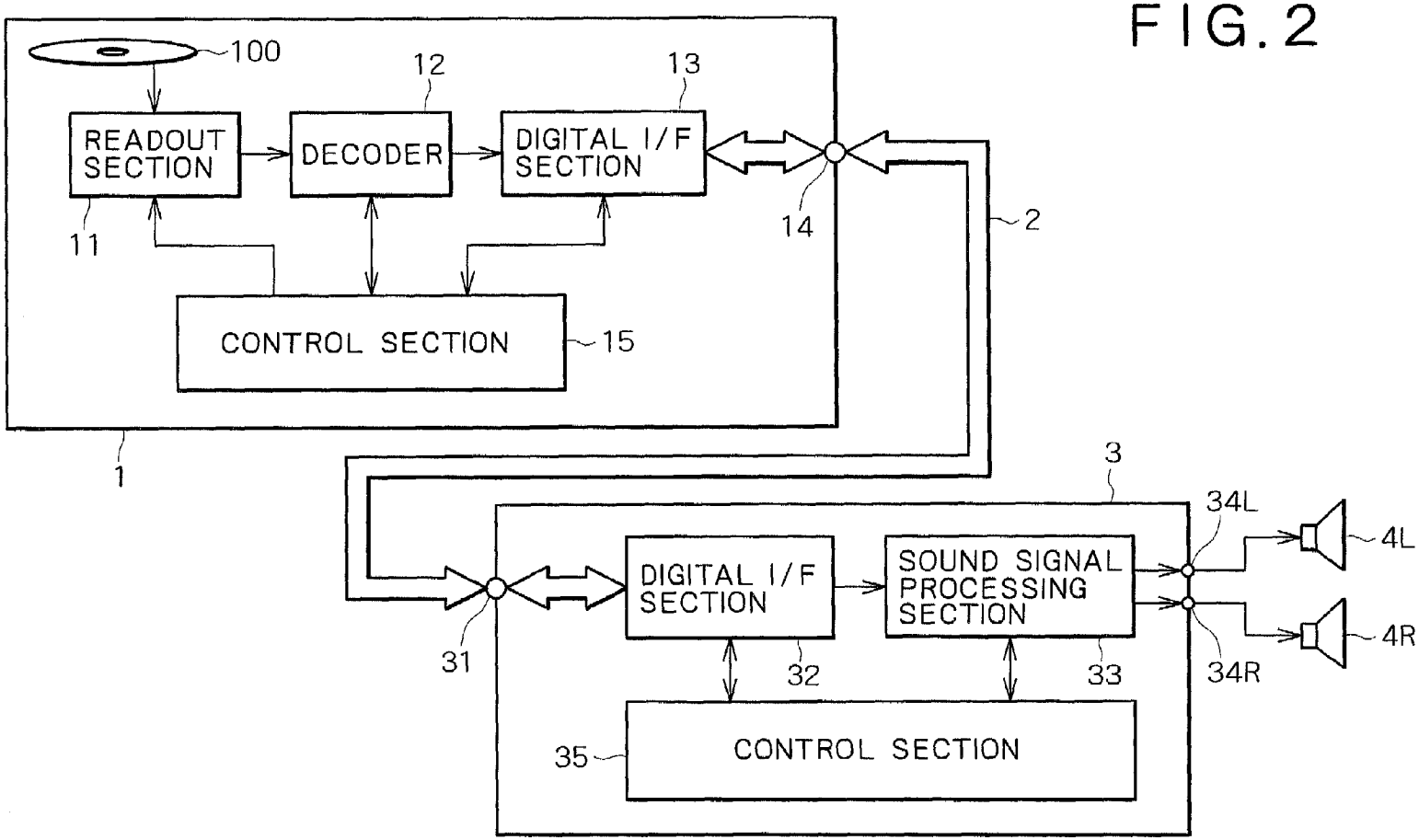
FIG. 2 is a block diagram showing a general configuration of a transmission apparatus and a reception apparatus of the transmission-reception system of FIG. 1.

FIG. 2 shows a more detailed configuration of the transmission-reception system shown in FIG. 1. Referring to FIG. 2, the DVD player 1 includes a readout section 11, a decoder 12, a digital I/F section 13, a digital input/output terminal 14 compatible with a digital bus of the IEEE 1394 standards, and a control section 15. It is to be noted that, in the present specification, the term I/F is used as an abbreviation of interface like the digital I/F section 13.

The audio amplifier 3 includes a digital input/output terminal 31 compatible with a digital bus of the IEEE 1394 standards, a digital I/F section 32, a sound signal processing section 33, a pair of output terminals 34L and 34R for left and right analog audio signals, and a control section 35.

A DVD 100 as a recording medium is loaded into the DVD player 1. The DVD 100 has audio data recorded thereon in accordance with the DVD-Audio standards as described above. The digital data recorded on the DVD 100 are read out by the readout section 11 including an optical pickup (not shown) and so forth. The digital data read out by the readout section 11 are supplied to the decoder 12 of the DVD-Audio standards.

The decoder 12 demultiplexes the digital data supplied thereto to extract audio data and ancillary data such as DMCT data necessary for down mix processing performed by the audio amplifier 3 and supplies the audio data and the ancillary data to the digital I/F section 13. The digital I/F section 13 forms audio data and ancillary data of a format for transmission from the audio data and the ancillary data from the decoder 12 and signals the thus formed audio data and ancillary data to the digital bus 2 through the digital input/output terminal 14.

The digital bus 2 is complied with the IEEE 1394 standards as described hereinabove. Therefore, digital data of audio data and so forth are transmitted in a format called AM824Data of the A&M protocol (Audio and Music Data Transmission Protocol) prescribed in the IEEE 1394 standards between the DVD player 1 and the audio amplifier 3.

The A&M protocol is prescribed as one of AV protocols which are rules for transmitting real time data such as audio data and video data using isochronous communication which is a synchronous communication system.

Figures 3, 4:
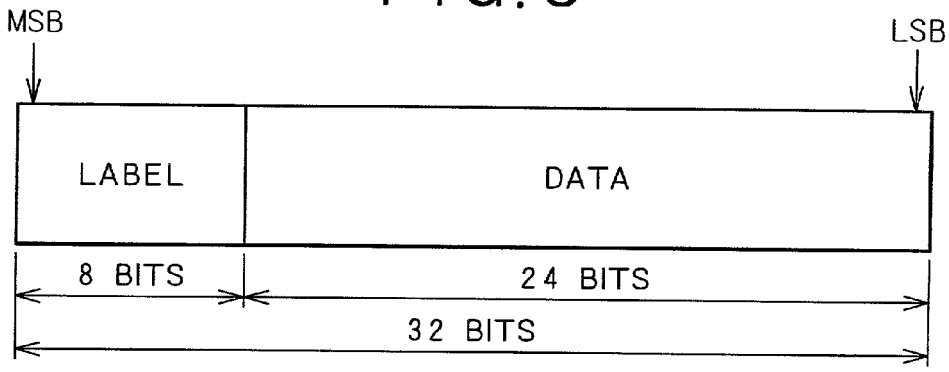
FIG. 3 is a diagrammatic view illustrating a format (AM824Data) of transmission data to be used for transmission of main information data such as audio data in the transmission-reception system of FIGS. 1 and 2.
FIG. 4 is a table illustrating data used as a label in the format illustrated in FIG. 3.

FIG. 3 illustrates the AM824Data which is used in the transmission-reception system and is a transmission data format for transmitting audio data. Referring to FIG. 3, the AM824Data format has a data length of 32 bits (=1 quadlet) which is a transmission unit of data of the IEEE 1394 standards and includes a label part of 8 bits in which a label for identification of contents of data is placed and a data part of 24 bits in which main information data such as audio data are placed.

FIG. 4 illustrates labels to be used in the 8-bit label part provided on the most significant bit (MSB) side of the AM824Data format illustrated in FIG. 3. In the left side column of FIG. 4, available labels are represented in hexadecimal number, and in the right side column of FIG. 4, significance contents represented by the labels are indicated.

It is to be noted that the alphabetical character "h" in the left side column of FIG. 4 represents that a numeral or a character preceding to this is represented as a hexadecimal number. In this manner, in the present specification, the alphabetical letter "h" added to the rear of a numeral or numerals or one or two of the alphabetical letters A, B, C, D, E and F represents that each preceding numeral or alphabetical letter is represented as a hexadecimal number.

In the transmission-reception system, as seen from FIG. 4, the values from 00h to 3Fh are allocated to IEC60958 conformant data and are used for transmission of linear PCM (Pulse Code Modulation) data or nonlinear PCM data of a data structure same as that of an existing biphase modulated IEC958 digital I/F. The values from 40h to 4Fh are allocated to multi-bit linear PCM audio data and are used, for example, for transmission of linear PCM audio data of the DVD-Audio standards and so forth.

The values from 50h to 57h are allocated to one-bit audio (Plain) data and the values from 58h to 5Fh are allocated to one-bit audio (Encoded) data, which are used for transmission of audio data, for example, of the SACD standards. The values 80h to 83h are allocated for MIDI (Musical Instrument Digital Interface) conformant data and are used for transmission of audio data of the MIDI standards.

The values from 88h to 8Bh are allocated to SMPTE (Society of Motion Picture and Television Engineers) time code conformant data and are used for transmission of the LTC (Longitudinal Time Code).

The values from C0h to EFh are allocated to ancillary data. The labels of the values are used for transmission of ancillary data such as, for example, DMCT data in DVD-Audio data transmission.

It is to be noted that, in the transmission-reception system, the values from 60h to 7Fh, 84h to 87h, 90h to BFh and F0h to FFh are reserved for the future use as seen in FIG. 4 but are not used at present.

As described hereinabove, in the transmission-reception system, audio data to be transmitted from the DVD player 1 to the audio amplifier 3 are linear PCM audio data of the DVD-Audio standards. Therefore, the digital I/F section 13 of the DVD player 1 shown in FIG. 2 divides audio data into data units having an equal size of each 24 bits and adds the labels from 40h to 4Fh to the divisional audio data to form transmission data sets of the format illustrated in FIG. 3, and signals the thus formed transmission data sets to the digital bus 2 so that they may be transmitted to the audio amplifier 3.

Not only such audio data but also ancillary data such as DMCT data described hereinabove are transmitted from the DVD player 1 to the audio amplifier 3. Also the ancillary data are transmitted basically in the format of the AM824Data. However, not only a label but also a sublabel is added to each transmission data unit for transmission of ancillary data.

Figures 5, 6A, 6B:
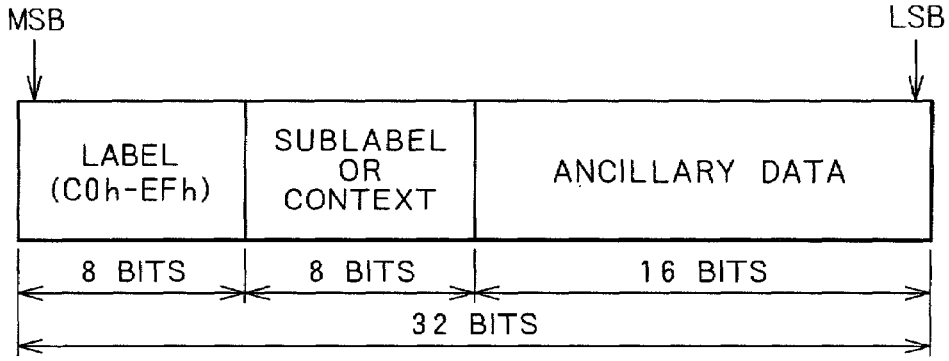
FIG. 5 is a diagrammatic view illustrating a format (AM824Data) of transmission data to be used for transmission of ancillary data such as DMCT data in the transmission-reception system of FIGS. 1 and 2.
FIGS. 6A and 6B are tables illustrating data used as a label for ancillary data in the format illustrated in FIG. 5.

FIG. 5 illustrates a transmission data format of the AM824Data for transmitting ancillary data. Referring to FIG. 5, the transmission data format of the AM824Data for transmission of ancillary data has a data length of 32 bits (=1 quadlet) and has a label part of 8 bits on the MSB side similarly to the transmission format of the AM824Data for transmission of audio data illustrated in FIG. 3.

When ancillary data are to be transmitted, however, a sublabel of 8 bits is added next to the label of 8 bits on the MSB side. Therefore, a sublabel part is provided next to the label part of the MSB side as seen in FIG. 5. Further, an ancillary data part of 16 bits is provided next to the sublabel part, and ancillary data are transmitted in a unit of 16 bits (2 bytes).

When ancillary data are to be transmitted, labels of the values from C0h to EFh are used as seen from FIG. 4 and also from the label part of FIG. 5. The labels of the values from C0h to EFh which are used for transmission of ancillary data in the present transmission-reception system are used properly in the following manner.

FIGS. 6A and 6B illustrate label values used for transmission of ancillary data. Referring to FIG. 6A, the label values C0h to EFh for ancillary data transmission are roughly divided into labels for general ancillary data from C0h to CFh and labels for ancillary data for different applications from D0h to EFh.

Referring to FIG. 6B, the label value CFh for general ancillary data is used to signify a state that the corresponding ancillary data part includes no ancillary data. The label value D0h for ancillary data for an application is used to indicate that the corresponding ancillary data are of the DVD-Audio standards. The label value D1h for ancillary data for another application is used to indicate that the corresponding ancillary data are of the SACD standards.

Accordingly, when the digital I/F section 13 of the DVD player 1 shown in FIG. 2 forms a transmission data set for transmission of ancillary data such as DMCT data supplied from the decoder 12, the value D0h ("11010000" in binary notation) is used as the label for the transmission data set.

Further, in order to transmit ancillary data, a sublabel is provided additionally. FIG. 7 illustrates sublabel values to be provided to ancillary data for the DVD-Audio standards. More particularly, representative examples applied to ancillary data for the DVD-Audio standards used in the transmission-reception system are illustrated in FIG. 7.

Referring to FIG. 7, in the left side column, sublabel values used actually are indicated in binary numbers, and in the right side column for the explanation, contents represented by the sublabel values are explained. The sublabel "00000000" is a value not used currently (Not Used). The sublabel "00000001" represents that the corresponding ancillary data must be transmitted in every block unit, and the sublabel "00000010" represents that the corresponding ancillary data must be transmitted before playback of audio data is started.

In the present transmission-reception system, when DMCT data used for down mix processing are transmitted, the three labels "00000100", "00000101" and "00000011" are used properly. The DMCT data are ancillary data which have such a great data amount that they must be transmitted divisionally in a plurality of times and do not allow regeneration by interpolation processing like audio data, and therefore, a miss of the DMCT data during its transmission process is not permitted and all of the DMCT data must be transmitted with certainty.

As described above, the DMCT data are data necessary for an apparatus of a transmission destination of multi-channel linear PCM audio data of the DVD-Audio standards, that is, necessary for the audio amplifier 3 in the present transmission-reception system, to perform down mix processing for the audio data received in accordance with a system compatible with the DVD-Audio standards and in accordance with the number of channels of the audio amplifier 3.

More particularly, the DMCT data are a kind of ancillary data to multi-channel linear PCM audio data of the DVD-Audio standards including information of the number of channels of audio data and the sampling frequency for each of the channels which are necessary in order to actually play back and use the audio data, various parameters and calculation methods necessary for down mix processing and so forth, and have a size of 288 bytes (2,304 bits). Accordingly, for transmission of the DMCT data from the DVD player 1 to the audio amplifier 3, they are transmitted divisionally by 144 times since they are transmitted as transmission data sets of the format illustrated in FIG. 5.

The DMCT data individually have important significance and a miss of any element of 288 bytes of the DMCT data disables normal down mix processing by the audio amplifier 3 on the reception side. Further, if an element of the DMCT data misses, then even if data interpolation processing which makes use of a correlation between adjacent data is performed like audio data, the missing data cannot be restored accurately. Therefore, such data interpolation processing does not make sense.

Therefore, in the transmission-reception system, the value "00000100" of the sublabel (DMCT start data sublabel) indicating that the corresponding ancillary data are the first data unit of the DMCT data is placed as the sublabel for a transmission data set which is formed to transmit the first data unit of 2 bytes of the DMCT data.

Further, the value "00000101" of the sublabel (continuation data sublabel) indicating that the corresponding ancillary data unit is data succeeding to the first data unit of the DMCT data is placed as the sublabel for each of transmission data sets which are formed to transmit those data units of the DMCT data which follow the first data unit of the DMCT data.

Furthermore, in the transmission-reception system, the DVD player 1 serving as a transmission apparatus transmits, immediately after it transmits the 144 divisional blocks or transmission data units of the DMCT data, a data set of 32 bits including a label, the sublabel "00000011" indicating that the corresponding data unit is the end of the DMCT data, a table parity of 1 bit which is information to be used for identification of DMCT data between different contents and the lower order 15 bits of the sum total of the DMCT data and having a function as end data.

Figure 8:
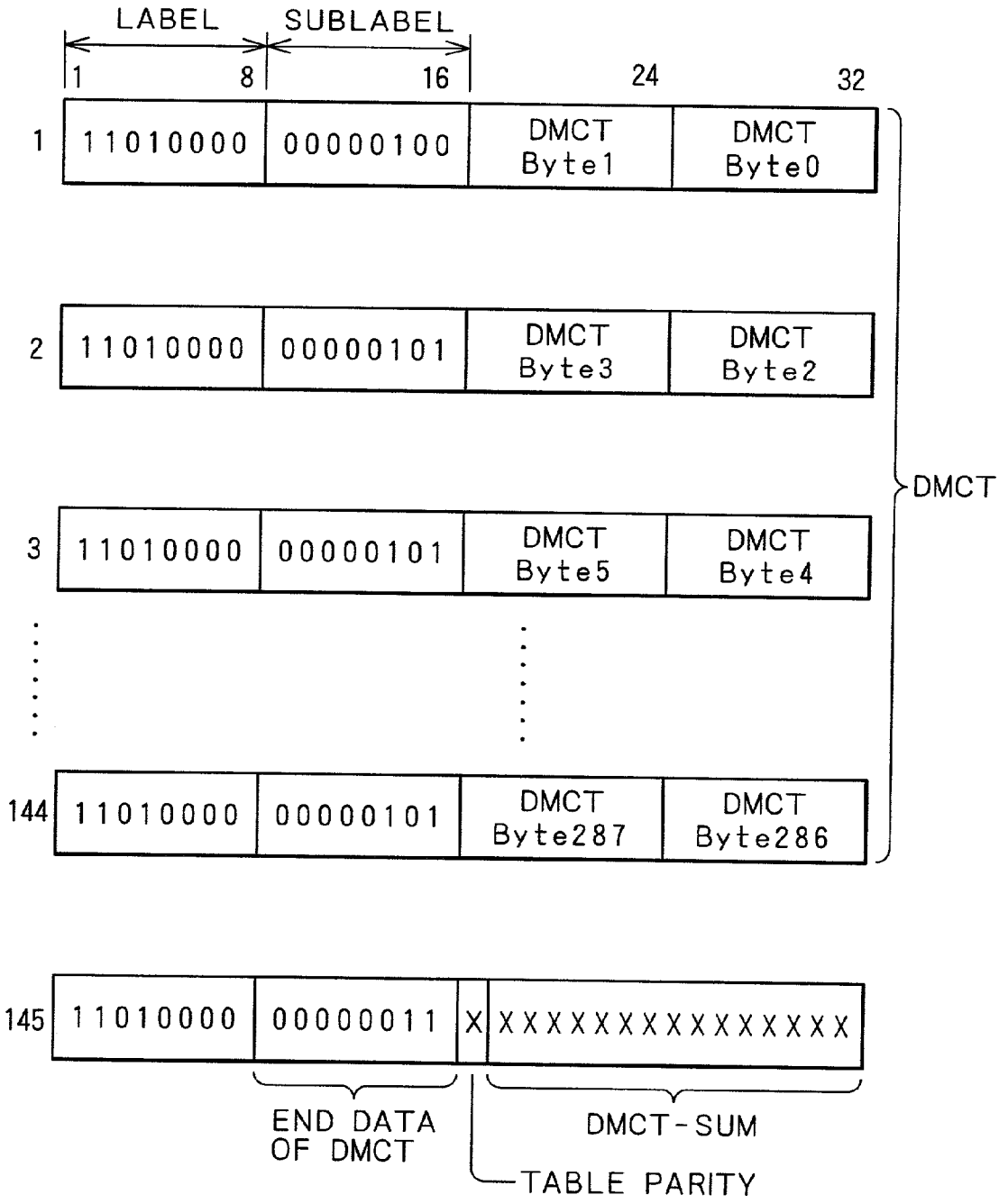
FIG. 8 is a diagrammatic view illustrating a transmission state of DMCT data which are ancillary data.

FIG. 8 illustrates transmission data sets when the DMCT data are transmitted. When the DMCT data of 288 bytes from the decoder 12 shown in FIG. 2 are to be transmitted, the digital I/F section 13 of the DVD player 1 divides the DMCT data into 144 data units each having an equal size of 2 bytes.

Each of the data units thus includes 2 bytes as seen from DMCT Byte1, DMCT Byte0, DMCT Byte3, DMCT Byte2, . . . in FIG. 8, and the label "11010000" (D0h) indicating that the corresponding ancillary data are ancillary data to DVD-Audio data is applied to the data units.

Further, the sublabel "00000100" indicating that the corresponding ancillary data unit is the first data unit is added to the data unit of the DMCT data of 2 bytes to be transmitted first whereas the sublabel "00000101" indicating that the corresponding ancillary data unit is a succeeding data set is added to each of those of the data units of the DMCT data which follow the first data set of the DMCT data to form such a transmission data set of 32 bits as illustrated in FIG. 5. The transmission data set of 32 bits formed in this manner is transmitted to the audio amplifier 3 over the digital bus 2.

As seen in FIG. 8, all of the DMCT data of 288 bytes can be transmitted with 144 sets of transmission data numbered from 1 to 144. Then, as the 145th set of data, transmission data which include a table parity of 1 bit and a sum total value (DMCT-sum) of the DMCT data are transmitted.

In this instance, the value "00000011" indicating that transmission of the DMCT data is ended is placed as the sublabel. In other words, a transmission data set whose label is "11010000" and whose sublabel is "00000011" is transmitted as end data indicating the end of transmission of the DMCT data.

Then, the sets of transmission data beginning with the transmission data set having the sublabel indicating that the corresponding ancillary data unit is the first data unit and ending with the transmission data set having the sublabel indicating that the transmission of the DMCT data is ended are transmitted repetitively after a fixed interval of time.

The audio amplifier 3 serving as a reception apparatus shown in FIG. 2 receives the digital data transmitted over the digital bus 2 by means of the digital I/F section 32 through the digital input/output terminal 31. Then, the digital I/F section 32 supplies the received digital data to the sound signal processing section 33 if the digital data are audio data of the DVD-Audio standards.

On the other hand, if the received digital data are a data unit of ancillary data of 2 bytes to which the sublabel indicating that it is the first data set of DMCT data is added, then the digital I/F section 32 places the data of the data unit as top data without fail. However, if the received digital data are a data unit of ancillary data of 2 bytes to which the sublabel indicating that it is a continuation data unit of the DMCT data, then the digital I/F section 32 writes (positions) the data of the data unit next to the last one of blocks or data units of the DMCT data having been received till then.

Even if the audio amplifier 3 fails in reception of some of the DMCT data, since the DMCT data are re-transmitted after a fixed interval of time from the transmission side as described above, the audio amplifier 3 can re-receive the DMCT data and play back (restore) the ancillary data of 288 bytes.

The restored DMCT data of 288 bytes are supplied from the digital I/F section 32 to the control section 35. The control section 35 controls the sound signal processing section 33 with several necessary ancillary data such as the received DMCT data to perform down mix processing to form analog audio signals of 2 channels. The analog audio signals are supplied to corresponding ones of the left speaker 4L and the right speaker 4R so that the speakers 4L and 4R emit sound in accordance with the audio data of the DVD-Audio standards recorded on the DVD 100.

Since the DMCT data which are a kind of ancillary data have the data length of 288 bytes and are transmitted to the audio amplifier 3 in the format illustrated in FIG. 5 wherein they are divided in 144 data units of an equal size of 2 bytes and a label and a sublabel are added to each of the data units, the sound signal processing section 33 of the audio amplifier 3 can discriminate whether or not all of the DMCT data are received by counting the number of the DMCT data unit to which the sublabel representing that the DMCT data unit is the start data unit of the DMCT data is applied and the DMCT data units to each of which the sublabel representing that the DMCT data unit is a continuation data unit of the DMCT data and discriminating whether or not the thus counted number is 144.

Further, since the transmission data which signify the end data and have information of the lower order 15 bits of the sum total value of the DMCT data are transmitted as the 145th transmission data set immediately after the end of the transmission of the DMCT data, the audio amplifier 3 of the reception side can definitely detect the end of reception of the DMCT data.

Also on the audio amplifier 3 side, whether or not all of the DMCT data are received accurately can be discriminated with certainty by calculating the sum total of the received DMCT data and comparing the value of the lower order 15 bits of the counted sum total with the value of the lower order 15 bits of the sum total value of the DMCT data included in the end data.

In this manner, by adding, to each transmission data unit of 32 bits illustrated in FIG. 5 to be used for transmission of DMCT data, a sublabel indicating that the transmission data unit is the start data unit of the DMCT data or another sublabel indicating that the transmission data unit is a continuation data unit of the DMCT data and transmitting the resulting DMCT units, an apparatus of the reception side, that is, the audio amplifier 3 in the present embodiment, can successively receive the ancillary data units transmitted thereto by isochronous communication and play back (restore) the ancillary data.

Further, by counting the number of transmission data units used for transmission of the DMCT data or using the sum total of the DMCT data, it can be discriminated accurately whether or not all of the DMCT data transmitted from the DVD player 1 have been received with certainty. If it is discriminated that all of the DMCT data have not been received as yet, then the audio amplifier 3 can take such a suitable countermeasure as to take steps to receive the DMCT data again.

Now, the digital I/F section 13 of the DVD player 1 which forms and transmits transmission data sets of the AM824Data format of the A&M protocol and the digital I/F section 32 of the audio amplifier 3 which receives and processes the transmission data sets of the AM824Data format of the A&M protocol are described below.

Figure 9:
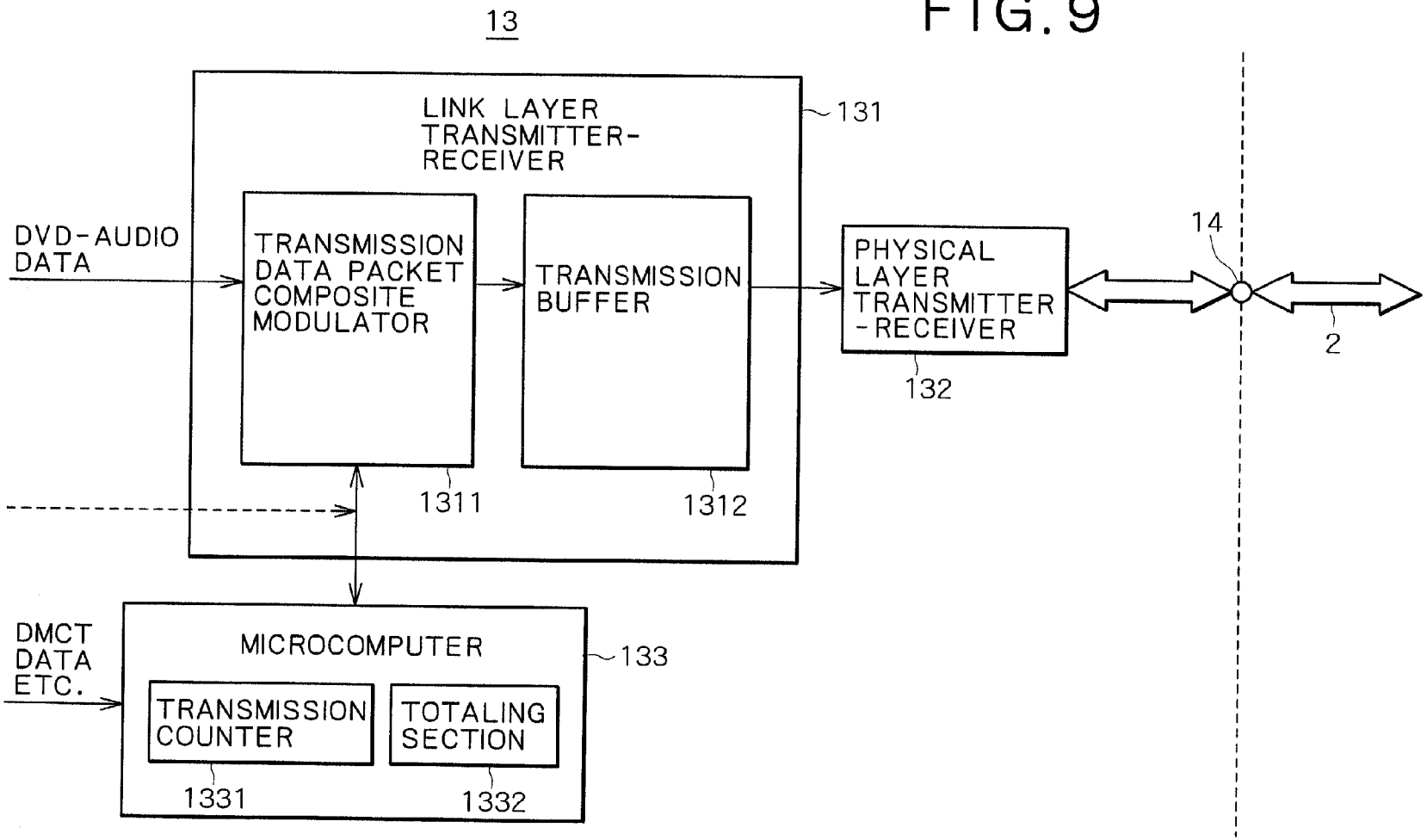
FIG. 9 is a block diagram showing a digital I/F section of a DVD player shown in FIG. 2.

First, the digital I/F section 13 of the DVD player 1 of the transmission side of digital data is described. FIG. 9 shows the digital I/F section 13 of the DVD player 1 and particularly shows a principal portion of the digital I/F section 13. Referring to FIG. 9, the digital I/F section 13 of the DVD player 1 includes a link layer transmitter-receiver 131, a physical layer transmitter-receiver 132, and a microcomputer 133.

The link layer transmitter-receiver 131 includes a transmission data packet composite modulator 1311 and a transmission buffer 1312. Meanwhile, although not shown in FIG. 9, the microcomputer 133 includes a CPU, a ROM and a RAM and has a function of controlling the link layer transmitter-receiver 131. The link layer transmitter-receiver 131 further has functions of a transmission counter 1331 and a totaling section 1332.

As described hereinabove with reference to FIG. 2, digital data read out from the DVD 100 are demultiplexed into linear PCM audio data (DVD-Audio data) of the DVD-Audio standards and ancillary data such as DMCT data by the decoder 12. The linear PCM audio data of the DVD-Audio standards are supplied to the modulator 1311 of the link layer transmitter-receiver 131 of the digital I/F section 13.

The modulator 1311 performs conversion of digital data supplied thereto into data of the AM824Data format and labeling or sublabeling of the resulting data under the control of the microcomputer 133. Where the digital data are audio data, the modulator 1311 forms transmission data sets (packets) of the format shown in FIG. 3 and signals the transmission data sets to the digital bus 2 through the transmission buffer 1312, physical layer transmitter-receiver 132 and digital input/output terminal 14 so that they are transmitted to the audio amplifier 3.

On the other hand, the DMCT data which are ancillary data demultiplexed by the decoder 12 are supplied to the microcomputer 133 of the digital I/F section 13. The microcomputer 133 supplies the DMCT data supplied thereto to the modulator 1311 and controls the modulator 1311 to form transmission data sets (packets) of the AM824Data format shown in FIG. 5

In particular, the modulator 1311 divides the DMCT data from the microcomputer 133 for each 2 bytes to form transmission data sets of the format shown in FIG. 5. Here, not only a label indicating that the data of the corresponding transmission data unit are DVD-Audio data but also a sublabel indicating that the data of the corresponding transmission data set are start data or continuation data are added to each of the transmission data sets.

Each of the transmission data sets for transmission of DMCT data formed by the modulator 1311 is signaled to the digital bus 2 through the transmission buffer 1312, physical layer transmitter-receiver 132 and digital input/output terminal 14 and transmitted to the audio amplifier 3 similarly to the audio data.

In this instance, the microcomputer 133 counts the number of transmissions of transmission data of 32 bits for transmission of the DMCT data based on information from the modulator 1311 using the transmission counter 1331 which may be implemented, for example, by a register and calculates the sum total of the DMCT data of the transmission data using the function of the totaling section 1332 and using, for example, the RAM of the microcomputer 133 itself as a working area. In the sum total calculation, for example, the DMCT data are added in a unit of one byte to calculate the sum total of the DMCT data.

In this instance, the counting of the transmission data is performed such that the count value is initialized when a data unit of transmission data whose sublabel designates the start data is transmitted and, thereafter, each time a data unit of transmission data is transmitted, the count value is incremented by one. Then, when the count value of data units of transmission data becomes equal to 143 and it is discriminated that all of the DMCT data of 288 bytes are transmitted, the microcomputer 133 controls the modulator 1311 to form end data including a table parity and information of the lower order 15 bits of the sum total of the DMCT data.

The modulator 1311 forms end data composed of a label, a sublabel representing that the data are end data, a table parity of 1 bit and data of the lower order 15 bits of the sum total of the DMCT data, and signals the end data to the digital bus 2 through the transmission buffer 1312, physical layer transmitter-receiver 132 and digital input/output terminal 14 so that the end data are transmitted to the audio amplifier 3.

The link layer transmitter-receiver 131 of the digital I/F section 13 has a function as division means for dividing data and another function as information addition means for adding a label or a sublabel to form a data set of transmission data of a data length of 32 bits in order to transmit data having a large data amount. Moreover, the link layer transmitter-receiver 131 and the microcomputer 133 cooperate with each other to realize a function as end data formation means.

It is to be noted that, while it is described here that ancillary data such as DMCT data are supplied from the decoder 12 for DVD-Audio data to the link layer transmitter-receiver 131 through the microcomputer 133 of the digital I/F section 13, the ancillary data need not be supplied in this manner. For example, ancillary data such as DMCT data are supplied from the decoder 12 for DVD-Audio data directly to the modulator 1311 of the digital I/F section 13 as indicated by a broken line arrow mark in FIG. 9 so that they may be processed by the modulator 1311.

Figure 10:
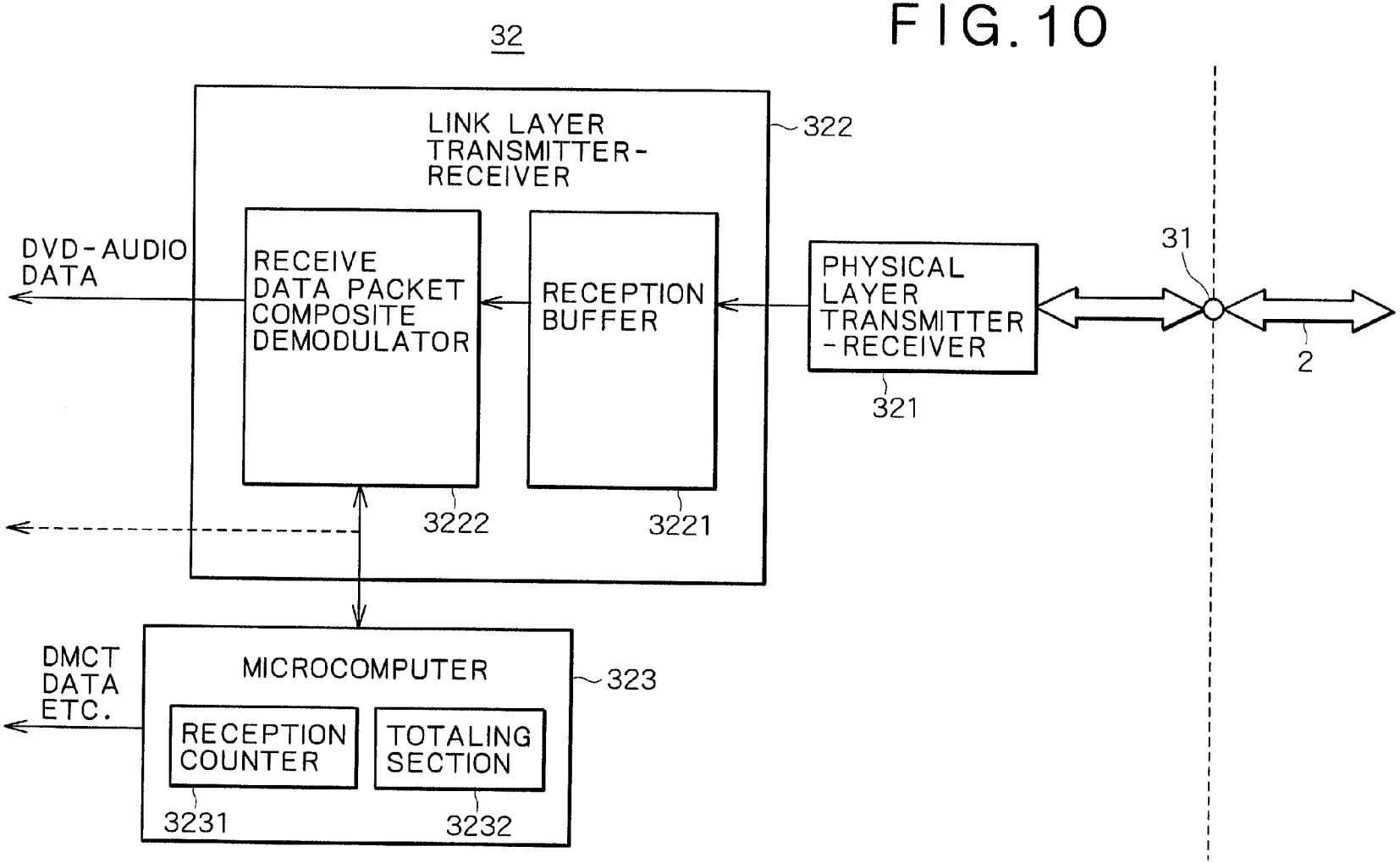
FIG. 10 is a block diagram showing a digital I/F section of an audio amplifier shown in FIG. 2.

Now, the digital I/F section 32 of the audio amplifier 3 of the reception side of digital data is described. FIG. 10 shows the digital I/F section 32 of the audio amplifier 3 and particularly shows a principal portion of the digital I/F section 32. Referring to FIG. 10, the digital I/F section 32 of the audio amplifier 3 includes a physical layer transmitter-receiver 321, a link layer transmitter-receiver 322, and a microcomputer 323.

The link layer transmitter-receiver 322 includes a reception buffer 3221 and a receive data packet composite demodulator 3222. Meanwhile, though not shown, the microcomputer 323 includes a CPU, a ROM and a RAM and has a function of controlling the link layer transmitter-receiver 322 and functions also of a reception counter 3231 and a totaling section 3232.

Digital data supplied through the digital bus 2 and the digital input/output terminal 31 are inputted to and received by the physical layer transmitter-receiver 321 of the digital I/F section 32 and then supplied to the demodulator 3222 through the reception buffer 3221 of the link layer transmitter-receiver 322.

The demodulator 3222 refers to the label of a data set of digital data supplied thereto and supplies, if the label indicates that the corresponding data are linear PCM audio data of the DVD-Audio standards, the linear PCM audio data of 24 bits next to the label to the sound signal processing section 33 in the following stage.

On the other hand, if the label of the data set of digital data supplied indicates that the corresponding data are ancillary data, then the demodulator 3222 supplies the digital data to the microcomputer 323. The microcomputer 323 refers also to the sublabel of the data set of the receive data supplied thereto to recognize what the ancillary data of the data set are like.

If the sublabel indicates that the corresponding ancillary data of the data set are the first data unit of the DMCT data, then the microcomputer 323 replaces the top data replaced formerly as the top data of the DMCT data with the ancillary data of the data set of 2 bytes on the LSB side of the receive data received in the present cycle. On the other hand, if the sublabel indicates that the corresponding ancillary data of the date set are data of a continuation data set of the DMCT data, then the microcomputer 323 writes (positions) the DMCT data of the data set of 2 bytes on the LSB side of the receive data received in the present cycle next to the last one of those of the DMCT data which have been received till then.

When this processing is performed, for example, the RAM of the microcomputer 323 is used as a working area. Then, if the microcomputer 323 performs replacement of the top data of the DMCT data, then it resets the value of the reception counter 3231, which is formed from, for example, a register of the microcomputer 323 itself, to "0" and thereafter increments the value of the reception counter by "1" each time it receives and processes transmission data of a data unit of the DMCT data.

Further, the microcomputer 323 uses the RAM of itself as a working area to calculate the sum total of the DMCT data parts of the receive data using the function of the totaling section 3232. In the calculation of the sum total, for example, the DMCT data received in a unit of 1 byte are successively added to calculate the sum total of the received DMCT data similarly as in the calculation of the sum total performed by the totaling section 1332 of the microcomputer 133 of the digital I/F section 13 of the DVD player 1.

If the reception counter 3231 of the microcomputer 323 indicates that transmission data of totaling 143 data units of the DMCT data are received after the reception of the transmission data of the data unit to which the sublabel indicating that the corresponding data are the DMCT data of the first data unit is added, then it can be recognized that all of the DMCT data are received.

It is to be noted that alternatively it is possible to start such counting from transmission data of a data unit to which the sublabel indicating that the corresponding data are the DMCT data of the first data unit is added and discriminate that all of the DMCT data are received when the count value till the end data becomes equal to 145 or otherwise to start such counting from transmission data of a data unit to which the sublabel designating the first DMCT data is added and discriminate that all of the DMCT data are received when the count value immediately before the end data are received is 145.

Further, the microcomputer 323 compares the sum total of the transmitted DMCT data included in the end data with the sum total of the received DMCT data calculated by the totaling section 3232 of the microcomputer 323. If the sum totals coincide with each other, then it can be discriminated that all of the DMCT data are received successfully without a miss.

On the other hand, if the count value of the reception counter 3231 of the microcomputer 323 does not exhibit the value determined in advance although the end data are received or if the sum total of the DMCT data included in the end data and the sum total of the received DMCT data are different from each other, then since the DMCT data are not transmitted correctly, transmission-reception of the DMCT data is performed again. This allows rapid and accurate transmission-reception of the DMCT data.

The DMCT data of 288 bytes restored by the microcomputer 323 in this manner are supplied from the microcomputer 323 to the control section 35 of the audio amplifier 3. The control section 35 controls the sound signal processing section 33 based on the ancillary data such as the DMCT data supplied thereto to perform down mix processing in accordance with the DVD-Audio standards to form audio signals of the two left and right channels.

The analog audio signals of the two left and right channels formed by the sound signal processing section 33 are supplied through the output terminals 34L and 34R for an analog audio signal to the speakers 4L and 4R, respectively, from which corresponding sound is emitted.

The digital I/F section 32 of the audio amplifier 3 has a function as reception means, and the link layer transmitter-receiver 322 and the microcomputer 323 of the digital I/F section 32 cooperate with each other to realize a function as restoration means for ancillary data such as DMCT data. Further, the microcomputer 323 has a function as receive data counting means for counting receive data and another function as sum total calculation means for calculating the sum total of received DMCT data.

It is to be noted that, while it is described that ancillary data such as DMCT data are supplied from the microcomputer 323 of the digital I/F section 32 to the control section 35 in the following stage, they need not be supplied in this manner. For example, such ancillary data may be supplied otherwise from the demodulator 3222 of the link layer transmitter-receiver 322 directly to a circuit in the following stage as indicated by a broken line arrow mark in FIG. 10.

In this manner, principally the modulator 1311 of the link layer transmitter-receiver 131 of the digital I/F section 13 of the DVD player 1 provides a function of dividing comparatively long data to be transmitted into transmission data units of an equal size and adding a label and a sublabel to each of the transmission data units to form sets of transmission data, and principally the demodulator 3222 and the microcomputer 323 of the digital I/F section 32 of the audio amplifier 3 has a function of restoring the digital data transmitted thereto divisionally in this manner.

It is described above that, in the digital I/F section 32 shown in FIG. 10, ancillary data such as DMCT data from the demodulator 3222 are supplied to and restored by the microcomputer 323 of the digital I/F section 32. However, such ancillary data need not be supplied and restored in this manner. For example, ancillary data of receive data units may be supplied through the microcomputer 323 to, for example, the control section 35 or the sound signal processing section 33 in the following stage so that they may be restored by the control section 35 or the sound signal processing section 33. Alternatively, received ancillary data may be supplied from the demodulator 3222 of the link layer transmitter-receiver 322 directly to the control section 35 in the following stage.

On the other hand, in order to describe the digital I/F section 13 of the DVD player 1 which plays back linear PCM audio data of the DVD-Audio standards, only the function for transmitting data is described above with reference to FIG. 9. Conversely, in order to describe the digital I/F section 32 of the audio amplifier 3 which processes audio data of the DVD-Audio standards, only the function of receiving data is described above with reference to FIG. 10.

However, the DVD player 1 and the audio amplifier 3 are connected through a digital bus of the IEEE 1394 standards and can originally transmit and receive bidirectionally. In other words, not only the DVD player 1 but also the audio amplifier 3 can mutually transmit and receive data and have the function as a transmission apparatus and the function as a reception apparatus shown in FIGS. 9 and 10, respectively.

Now, a transmission process of DMCT data by the DVD player 1 and a reception process of the DMCT data by the audio amplifier 3 in the transmission-reception system described above are described.

Figure 11:
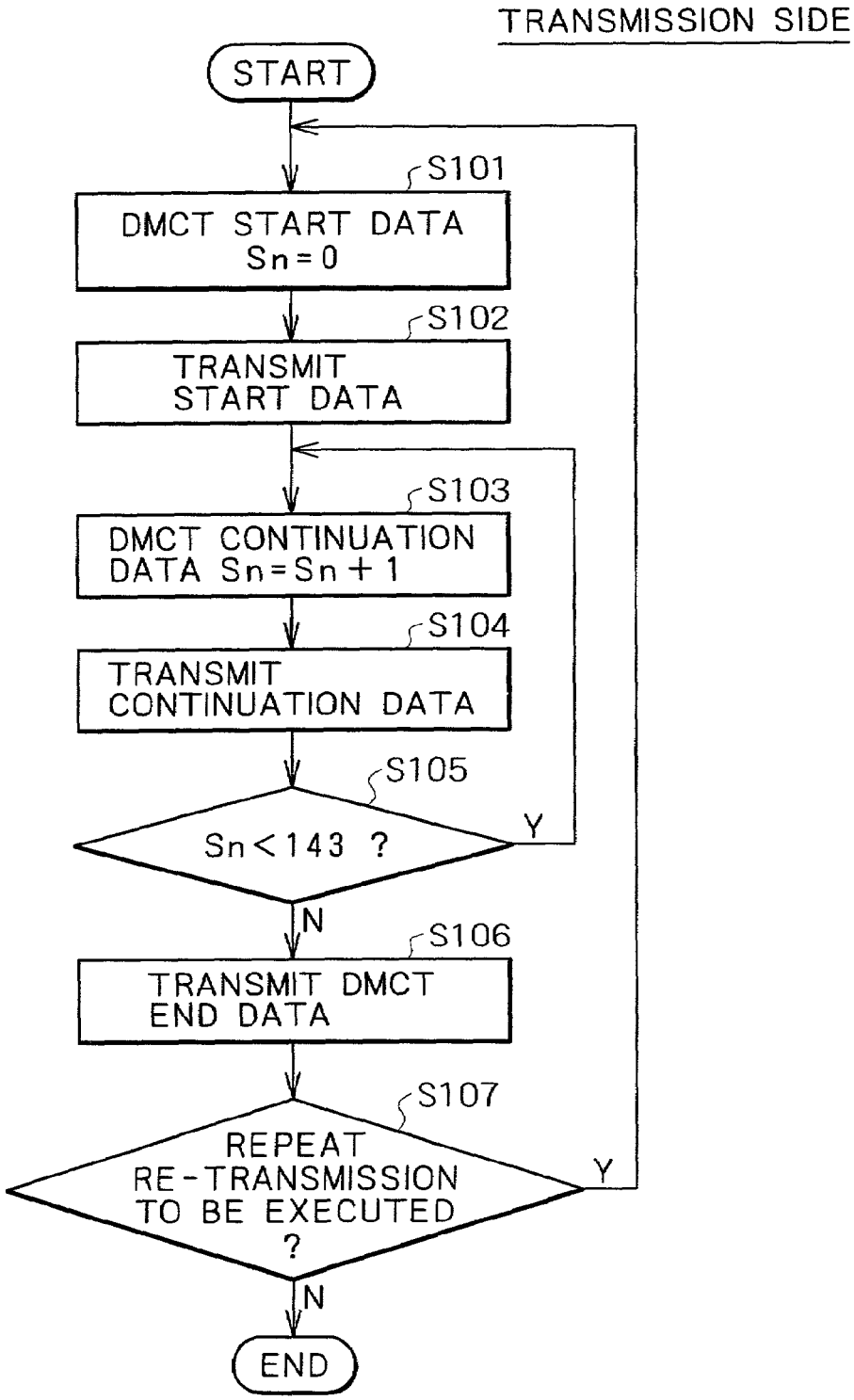
FIG. 11 is a flow chart illustrating processing of the DVD player (transmission apparatus) shown in FIG. 2 when DMCT data are transmitted divisionally.

First, a process when DMCT data are transmitted from the DVD player 1 is described with reference to FIG. 11. FIG. 11 illustrates a process of the digital I/F section 13 when DMCT data are transmitted from the DVD player 1 and more specifically illustrates a process principally of the microcomputer 133 which controls the link layer transmitter-receiver 131.

As described hereinabove, DMCT data from the decoder 12 for DVD-Audio data are supplied to the modulator 1311 of the link layer transmitter-receiver 131, for example, through the microcomputer 133. In this instance, the microcomputer 133 controls the modulator 1311 to form a set of transmission data in which information representing that the transmission data are start data is included as a sublabel and initializes a count value Sn of the transmission counter 1331 to 0 (step S101).

Then, the microcomputer 133 controls the modulator 1311 to form and transmit the set of transmission data for transmission of the first unit of DMCT data formed in step S101 (step S102). Then, the microcomputer 133 controls the modulator 1311 to form a set of transmission data in which information representing that the transmission data are continuation data is included as a sublabel and increments the count value Sn of the transmission counter 1331 by 1 (step S103).

Thereafter, the microcomputer 133 controls the modulator 1311 to transmit the set of transmission data formed in step S103 in which the sublabel representing that the transmission data are continuation data is included (step S104).

Then, the microcomputer 133 discriminates whether or not the count value Sn of the transmission counter 1331 is lower than 143 (step S105). If the microcomputer 133 discriminates that the count value Sn is lower than 143, then it repeats the processing in the steps beginning with step S103. On the other hand, if the microcomputer 133 discriminates that the count value Sn of the transmission counter 1331 is not lower than 143, that is, is equal to or higher than 143, then it controls so that the DMCT end data may be transmitted (step S106) and then discriminates whether or not it is necessary to repetitively transmit the DMCT data again (step S107).

If the microcomputer 133 discriminates in step S107 that it is necessary to repetitively transmit the DMCT data again, then it repeats the processing in the steps beginning with step S101 to transmit the DMCT data from the beginning again. On the other hand, if the microcomputer 133 discriminates in step S107 that it is not necessary to repetitively transmit the DMCT data again, then it ends the transmission process of the DMCT data illustrated in FIG. 11.

Figure 12:
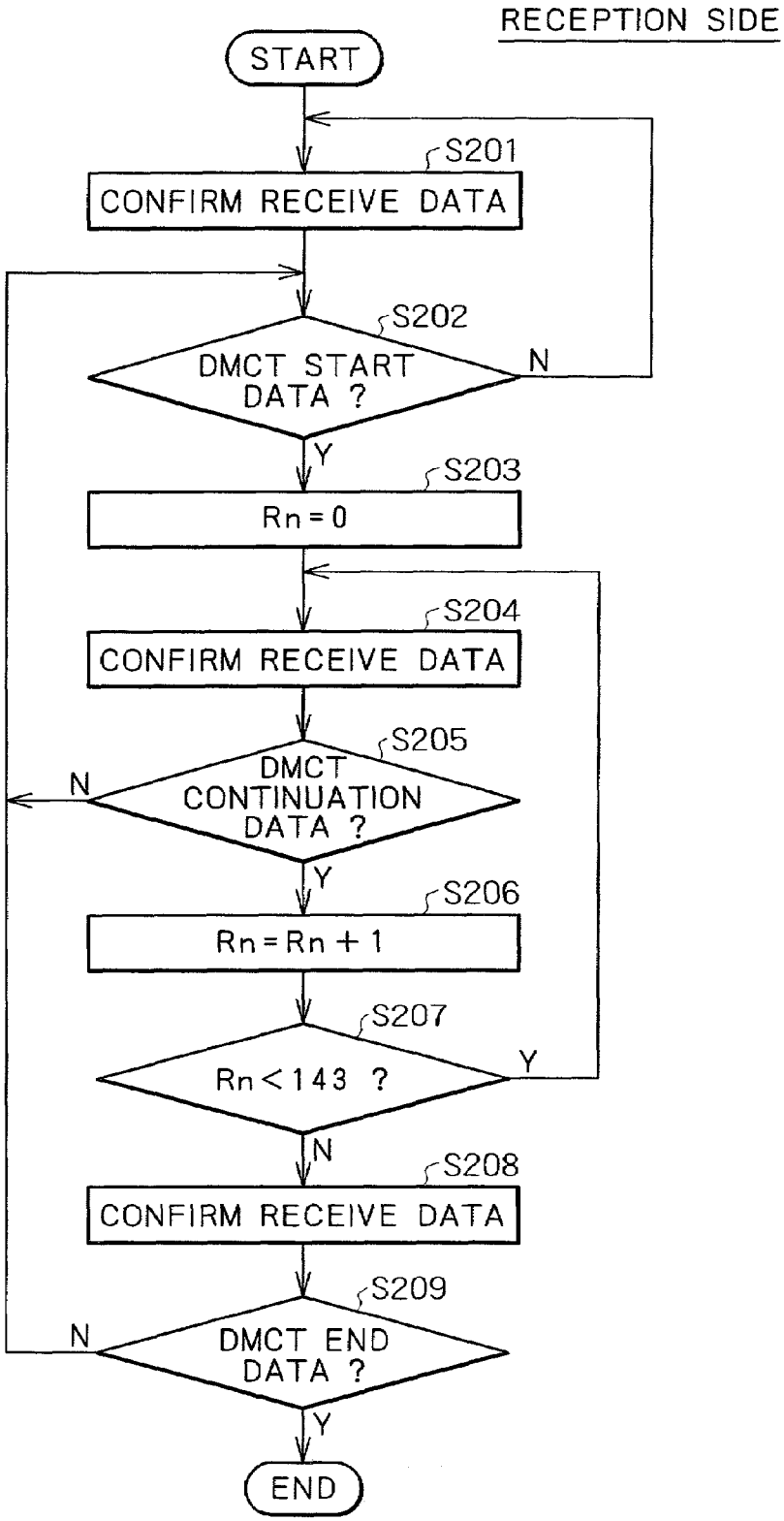
FIG. 12 is a flow chart illustrating processing of the audio amplifier (reception apparatus) side shown in FIG. 2 when DMCT data transmitted divisionally are received.

Now, a process executed by the audio amplifier 3 when DMCT are received is described with reference to FIG. 12. FIG. 12 illustrates a flow chart for illustrating a process of the digital I/F section 32 when the audio amplifier 3 receives DMCT data and more specifically illustrates processing principally of the microcomputer 323 which controls the link layer transmitter-receiver 322.

The processing illustrated in FIG. 12 is executed when the digital I/F section 32 of the audio amplifier 3 receives a set of transmission data in which a sublabel regarding DMCT data is included. First, the microcomputer 323 confirms the receive data set received from the demodulator 3222 of the link layer transmitter-receiver 322 (step S201) and discriminates whether or not a sublabel (start data sublabel) representing that the data of the received data unit are data of the first unit of the DMCT data is included in the received data (step S202).

If it is discriminated in step S202 that the sublabel representing that the data of the received data unit are data of the first unit of DMCT data is not included in the received data, then the microcomputer 323 waits for the DMCT data transmitted from the beginning again.

On the other hand, if it is discriminated in step S202 that the sublabel representing that the data of the received data unit are data of the first unit of DMCT data is included in the received data, then the microcomputer 323 replaces the top DMCT data with the DMCT data included in the received data set and initializes a count value Rn of the reception counter 3231 to 0 (step S203).

Then, the microcomputer 323 confirms receive data of a data set received subsequently (step S204) and discriminates whether or not the sublabel (continuation data sub label) representing that the data of the received data unit are data of a continuation unit is included in the received data set (step S205). If it is discriminated that the sublabel representing that the data of the received data unit are data of a continuation set is not included in the received data set, then the microcomputer 323 repeats the processing in the steps beginning with step S202, in which the microcomputer 323 discriminates whether or not the sublabel representing that the data of the received data unit are data of the first data unit is included in the received data set.

On the other hand, if it is discriminated in step S205 that the sublabel representing that the data of the received data unit are data of a continuation data unit is included in the received data set, then the microcomputer 323 writes the DMCT data included in the received data unit next to the last one of those of the DMCT data units which have been received till then and increments the count value Rn of the reception counter 3231 by 1 (step S206).

Then, the microcomputer 323 discriminates whether or not the count value Rn of the reception counter 3231 is lower than 143 (step S207). If the microcomputer 323 discriminates that the count value Rn is lower than 143, then it repeats the processing in the steps beginning with step S204. On the other hand, if the microcomputer 323 discriminates in step S207 that the count value Rn of the reception counter 3231 is not lower than 143, that is, is equal to or higher than 143, then it discriminates that all of the 144 units of the DMCT data are received and then confirms receive data received subsequently (step S208).

Then, the microcomputer 323 discriminates whether or not the receive data confirmed in step S208 are the DMCT end data (step S209). If the microcomputer 323 discriminates that the receive data are the DMCT end data, then it ends the processing illustrated in FIG. 12. On the other hand, if it is discriminated that the receive data are not the DMCT end data, then the microcomputer 323 repeats the processing in the steps beginning with step S202.

Though not illustrated in FIG. 12, the microcomputer 323 confirms whether or not all of the DMCT data to be transmitted are received accurately using the sum total of DMCT data included in the end data received in the 145th set of data from the transmission data of the top unit of the DMCT data to which the sublabel that the data of the top unit are the start data is added, and if all of the DMCT data are not received accurately, then the microcomputer 323 requests the DVD player 1 to transmit the DMCT data again. The DVD player 1 transmits the same DMCT data repetitively after a predetermined interval of time as described above to satisfy the request.

Then, if transmission of the DMCT data is not performed again for some reasons on the transmission side and the reception side does not successfully receive the DMCT data even after lapse of a predetermined interval of time, then, for example, even if audio data which are main data are received, the reception side does not perform playback processing and mutes its sound output thereby to prevent such a trouble as generation of unfamiliar sound or noise. Further, if necessary, an error message is displayed on a display unit of the reception apparatus side. Further, such occurrence of an error may be reported also to the transmission side if necessary.

In this manner, when DMCT data are transmitted and received, the two different sublabels including the sublabel representing that the corresponding data are data of the first data unit of DMCT data and the sublabel representing that corresponding data are data of a continuation data unit of the DMCT data are used, and the number of transmission data units are counted by the transmission side apparatus while the number of receive data units is counted by the reception side apparatus. Consequently, DMCT data of 288 bytes can be transmitted rapidly and with certainty without performing complicated processing and can be received rapidly and with certainty.

In particular, although DMCT data transmitted divisionally are not sequenced, since the first data unit and succeeding data units can be identified definitely from each other, the reception side apparatus can restore the DMCT data simply and readily by repeating, after data of the first data unit (top data unit) are detected with certainty, the same processing for all of data of the data units succeeding to the first data unit, and utilize the thus restored DMCT data. Accordingly, the transmission quality of DMCT data can be assured, and the load upon designing of the transmission apparatus, reception apparatus and transmission-reception system can be reduced.

As a result, when transmission of DMCT data is interrupted temporarily and then the transmission is re-started, the reception side apparatus can discriminate whether the transmission is to be resumed from the state at the point of time of the interruption or the DMCT data are re-transmitted again from the beginning, and take a suitable countermeasure based on the discrimination.

In particular, when transmission of DMCT data is interrupted temporarily, the following two interruption states can be presupposed. In particular, it is a first interruption state that, since the interruption is caused by an external factor such as, for example, bus resetting of the IEEE 1394 standards, information of DMCT data and conditions of the counter value and so forth prior to the interruption are not lost in any of the transmission side and the reception side and reception of the DMCT data can be resumed immediately. It is a second interruption state that, since the interruption is caused by an abnormal state of, for example, the transmission side or the reception side, such information or conditions as described above may be lost on the transmission side or the reception side or else by both of them and the reception side need perform reception of the DMCT data from the beginning again.

Then, if transmission of DMCT data is interrupted and received DMCT data remain in the reception side apparatus, that is, in the microcomputer 323 of the digital I/F section 32 of the audio amplifier 3 in the transmission-reception apparatus, then the microcomputer 323 discriminates that this corresponds to the first state described above and can discriminate DMCT data re-transmitted from the DVD player 1 as DMCT data corresponding to the count value next to the count value indicated by the reception counter to resume reception. Then, if the number of received data units of the DMCT data and the count value of the reception counter coincide with each other at a point of time when a data set having the sublabel designating the end of the transmission of the DMCT data is received, then the microcomputer 323 discriminates that the reception of all of the DMCT data is completed.

Figure 13:
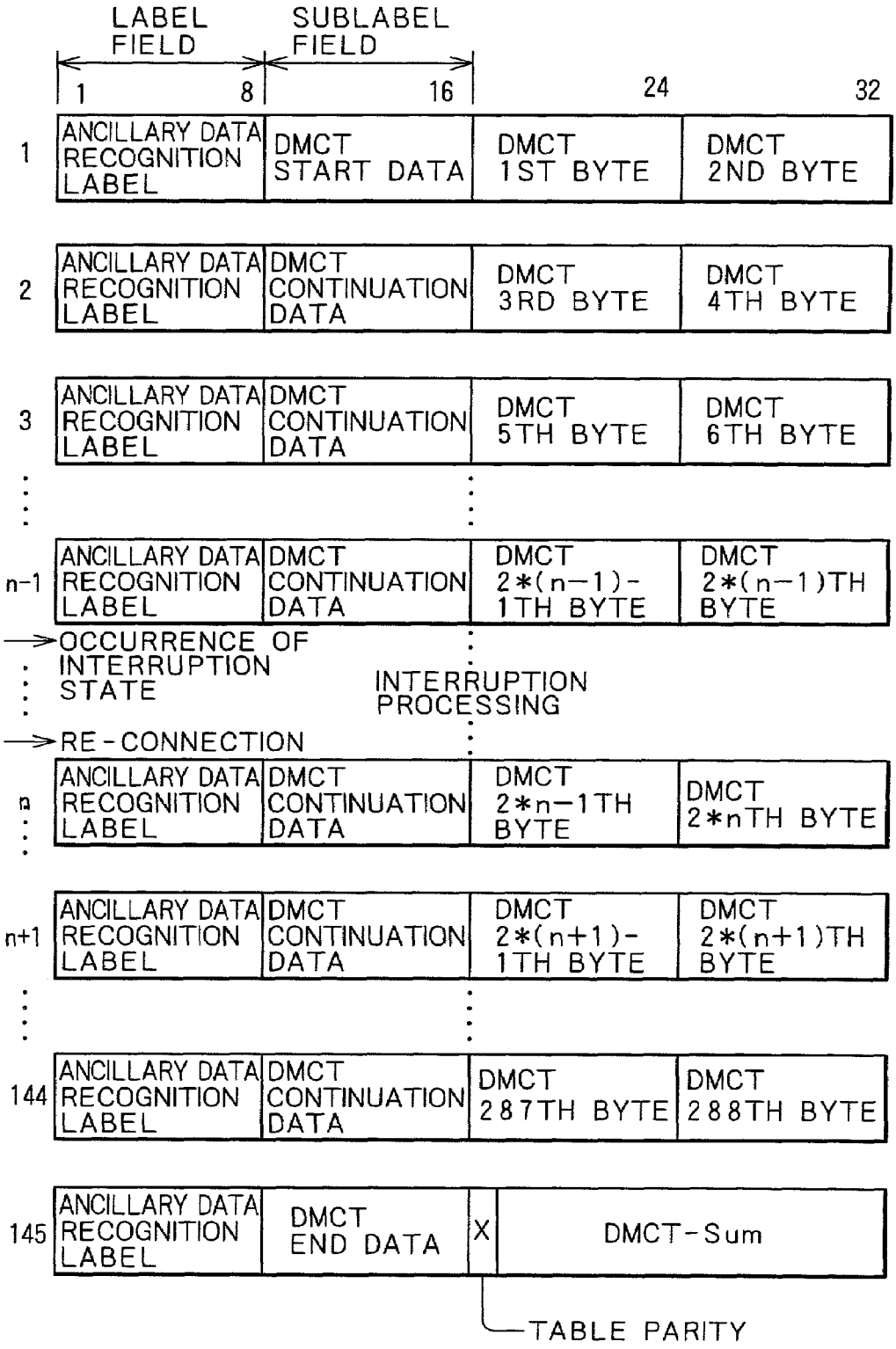
FIG. 13 is a diagrammatic view illustrating processing of DMCT data transmitted divisionally after interruption of the transmission.

This state is illustrated in FIG. 13. Referring to FIG. 13, if transmission of DMCT data is interrupted when the count value of the reception counter is n−1, then if receive data from the top data to the (n−1)-th data remain in the microcomputer 323, then the transmission-reception processing may be resumed from the n-th data unit of the DMCT data.

Thus, if the transmission-reception processing is resumed from the n-th DMCT data, then all of the DMCT data beginning with the data of the top data unit of the DMCT data (first data unit of the DMCT data) and ending with the data of the tail data unit of the DMCT data (144th data unit of the DMCT data) can be received and utilized.

On the other hand, if transmission of DMCT data is interrupted and the received DMCT data or the count value of the reception counter does not remain in the reception side apparatus, that is, in the microcomputer 323 of the digital I/F section 32 of the audio amplifier 3 in the transmission-reception apparatus or the data unit number of the DMCT data and the count value of the reception counter do not coincide with each other, then the microcomputer 323 discriminates that this corresponds to the second state described above and requests transmission of the DMCT data from the beginning from the DVD player 1.

Figure 14:
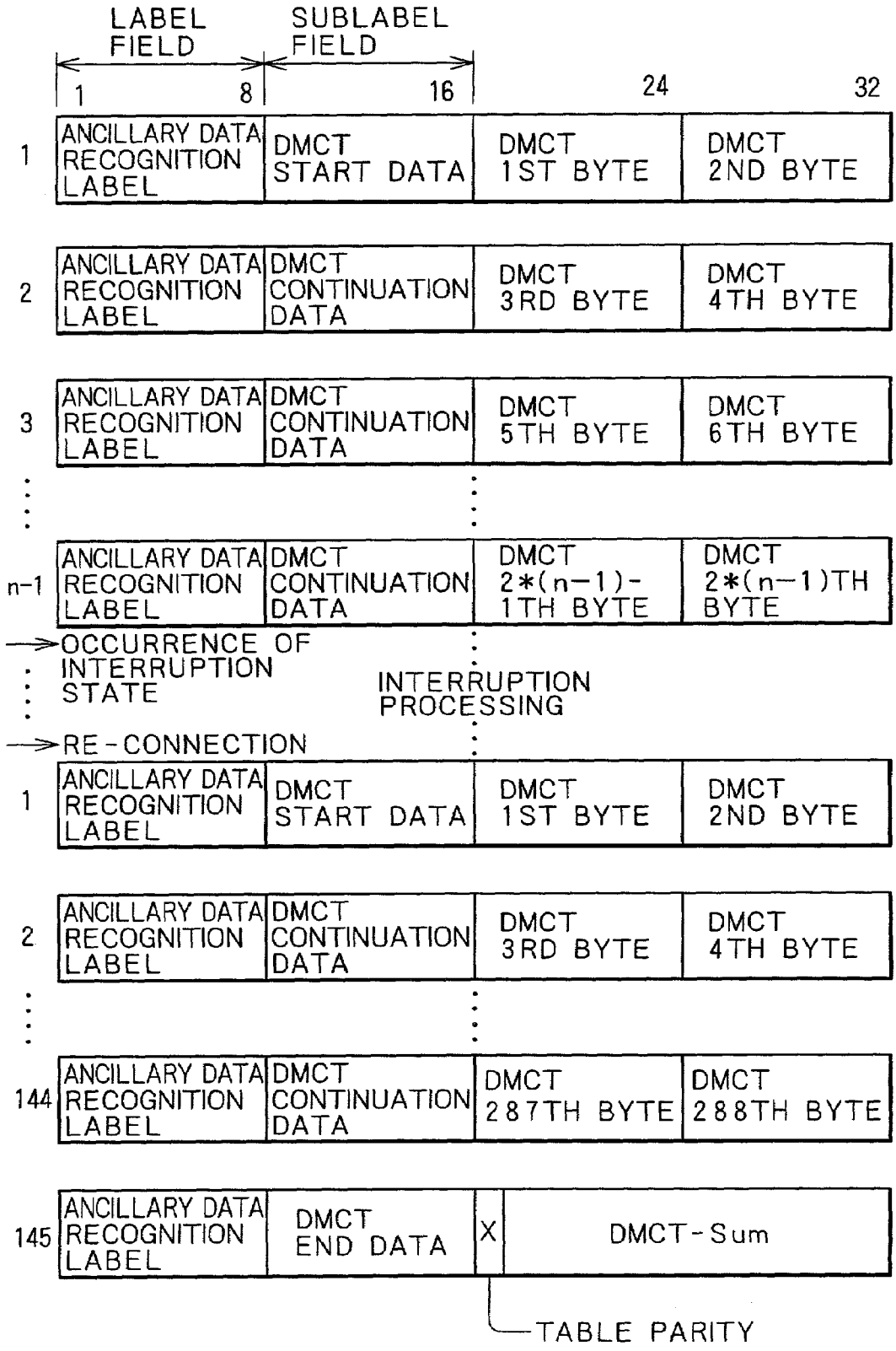
FIG. 14 is a similar view but illustrating another processing of DMCT data transmitted divisionally after interruption of the transmission.

This state is illustrated in FIG. 14. Referring to FIG. 14, if transmission of DMCT data is interrupted when the count value of the reception counter is n−1, then if DMCT data or the count value of the reception counter does not remain normally, then the transmission-reception processing must be performed beginning with the first data unit of the DMCT data.

Thus, the transmission-reception processing of the DMCT data is resumed beginning with the first data unit of the DMCT data. Consequently, all of the DMCT data beginning with the data of the top data unit of the DMCT data (first data unit of the DMCT data) and ending with the data of the tail data unit of the DMCT data (144th data unit of the DMCT data) can be utilized by receiving them provided again from the transmission side apparatus.

In this manner, all of DMCT data can be transmitted accurately without using an asynchronous communication method and without adding different data for sequencing to divisional data units of the DMCT data. Further, since the data length of digital data (a data set) to be transmitted divisionally is determined in advance and also the number of times by which the digital data are transmitted divisionally is known in advance, by counting the received data set, the reception side apparatus can manage the transmission procedure of the DMCT data and can grasp whether or not all of the DMCT data are received.

Further, since the end data are transmitted immediately after the last divisional data (last data set) of the DMCT data, the reception side apparatus can use the end data to discriminate whether or not all of the DMCT data are transmitted. Further, the reception side apparatus can use the sum total of the transmitted DMCT data included in the end data and the sum total of the received DMCT data to discriminate whether or not all of the DMCT data are received accurately.

It is to be noted that, while the transmission-reception system described above uses linear PCM audio data of the DVD-Audio standards as main information data and uses DMCT data for use for down mix processing as ancillary data which are transmitted divisionally but do not permit any miss thereof, the main information data and the ancillary data are not limited to the specific data mentioned above.

In particular, the main information data may be audio data or video data of various standards. Meanwhile, the ancillary data may be text data, duplicate control information used for duplication control or copyright information for conveying information regarding an owner of the copyright. In other words, the present invention can be applied to various kinds of ancillary data which are transmitted divisionally on the real time basis but do not permit any miss (drop) thereof during a process of transmission.

Further, the transmission-reception system described above uses a digital bus of the IEEE 1394 standards as the digital bus for connection between equipments between which digital data are transmitted and received. However, the digital bus is not limited to a digital bus of the IEEE 1394 standards. The present invention can be applied also where various other digital buses are used to transmit digital data.

In particular, the present invention can be applied to transmission of data performed divisionally by a plural number of times in a transmission-reception system which uses a high speed digital bus different from a digital bus of the IEEE 1394 standards and identifies each divisional transmission data unit by a label added to it. In short, the present invention can be applied to a system configured such that a protocol itself does not allow hand-shaking of communication between the transmission side and the reception side but data are transmitted in a one-way manner like an isochronous communication system of a digital bus of the IEEE 1394 standards. The present invention provides an effective countermeasure for establishing status-synchronism between the transmission side and the reception side of such a system as just described.

Further, the transmission-reception system described above uses a DVD player as the transmission apparatus and uses an audio amplifier as the reception apparatus. However, the transmission apparatus and the reception apparatus are not limited to the specific apparatus mentioned. In particular, the transmission apparatus according to the present invention can be applied to personal computers which transmit digital data and various playback apparatus for digital data. Further, the reception apparatus according to the present invention can be applied to personal computers which receive and process digital data transmitted thereto, digital data outputting apparatus, playback apparatus or recording apparatus and so forth.

In other words, the present invention can be applied at least to various transmission apparatus which transmit digital data, which are transmitted divisionally but do not permit any miss thereof, on the real time basis. Further, the present invention can be applied to various reception apparatus which receive digital data which are transmitted divisionally on the real time basis but do not permit any miss thereof.

Furthermore, in the transmission-reception system described above, the DVD player 1 serving as a transmission apparatus and the audio amplifier 3 serving as a reception apparatus are connected to each other by a wire. However, the present invention can be applied also where they are connected to each other by radio.

While a preferred embodiment of the present invention has been described using specific terms, such description is for illustrative purposes only, and it is to be understood that changes and variations may be made without departing from the spirit or scope of the following claims.

What is claimed is:

1. A transmission-reception system for transmitting and receiving digital data, which must be transmitted divisionally in a plural number of times and do not admit a miss thereof, on the real time basis, comprising:

a transmission apparatus including;

division means for dividing the digital data into a predetermined number of data units of an equal size, information addition means for adding, to that one of the transmission data units obtained by the division of the digital data by said division which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit, transmission data sum total calculation means for calculating the sum total of data in the data units divided by said division means, and transmission means for transmitting the transmission data units to which the information is added by said information addition means on the real time basis; and a reception apparatus including:

reception means for receiving the data units transmitted on the real time basis from said transmission apparatus, receive data sum total calculation means for calculating the sum total of received data received by said reception and including data of the data unit to which the information representing that the data unit is the first data unit is added and data of the data units to each of which the information representing that the data unit is a succeeding data unit is added, and restoration means for positioning that one of the data units received by said reception means to which the information representing that the data unit is the first data unit as top data is added and positioning each of the data units received following the first data unit to which the information representing that the data unit is a succeeding data unit is added as succeeding data next to the last one of the data units which have been received till then.

2. A transmission-reception system according to claim 1, wherein said transmission apparatus further includes end data formation means for forming end data representative of the end of transmission of the digital data transmitted as the transmission data units and said transmission means transmits the end data from said end data formation means immediately after the last one of the transmission data units of the digital data to be transmitted is transmitted, and said reception apparatus includes discrimination means for discriminating whether or not the data of any of the data units received by said reception means are the end data.

3. A transmission-reception system according to claim 2, wherein said end data formation means forms the end-data which include the sum total calculated by said transmission data sum total calculation means, and said reception apparatus further includes discrimination means for comparing the sum total of the received data calculated by said receive data sum total calculation means with the sum total of the data of the data units included in the end data to discriminate whether or not all of the digital data transmitted are received normally.

4. A transmission-reception system according to claim 1, wherein the digital data to be transmitted are divided into a predetermined number of data units, and said reception apparatus includes counting means for counting the number of the data unit to which the information representing that the data unit is the first data unit is added and the data units to each of which the information representing that the data unit is a following data unit is applied.

5. A transmission-reception system according to claim 1, wherein the digital data are text data.

6. A transmission-reception system according to claim 1, wherein main information data in the form of digital data can be transmitted between said transmission apparatus and said reception apparatus on the real time basis, an the digital data are duplication control information or copyright information regarding the main information data or ancillary data for allowing said reception apparatus to play back the main information data in accordance with a method or standards determined in advance.

7. A transmission-reception system according to claim 1, wherein main information data in the form of digital data can be transmitted between said transmission apparatus and said reception apparatus, and the digital data are ancillary data for allowing said reception apparatus to play back multi-channel digital audio data as the main information data in accordance with a number of channels of said reception apparatus and in accordance with a method or standards determined in advance.

8. A transmission apparatus, comprising:

division means for dividing digital data, which must be transmitted divisionally in a plural number of times and do not admit a miss thereof, into a predetermined number of data units of an equal size;

information addition means for adding, to that one of the transmission data units obtained by the division of the digital data by said division means which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit;

transmission data sum total calculation means for calculating the sum total of data in the data units divided by said division means; and transmission means for transmitting the transmission data units to which the information is added by said information addition means on the real time basis.

9. A transmission apparatus according to claim 8, further comprising end data formation means for forming end data representative of the end of transmission of the digital data transmitted as the transmission data units, and wherein said transmission means transmits the end data from said end data formation means immediately after the last one of the transmission data units of the digital data to be transmitted is transmitted.

10. A transmission apparatus according to claim 9, wherein said end data formation means forms the end data which include the sum total calculated by said transmission data sum total calculation means.

11. A transmission apparatus according to claim 8, wherein the digital data are text data.

12. A transmission apparatus according to claim 8, wherein said transmission apparatus can transmit main information data in the form of digital data on the real time basis, and the digital data are duplication control information or copyright information regarding the main information data or ancillary data for allowing a reception apparatus to play back the main information data in accordance with a method or standards determined in advance.

13. A transmission apparatus according to claim 8, wherein said transmission apparatus can transmit main information data in the form of digital data on the real time basis, and the digital data are ancillary data for allowing said reception apparatus to play back multi-channel digital audio data as the main information data in accordance with a number of channels of said reception apparatus and in accordance with a method or standards determined in advance.

14. A reception apparatus for receiving data successively transmitted thereto on the real time basis and including digital data, which must be transmitted divisionally in a plural number of times and do not admit a miss thereof, divided into a plurality of data units of an equal size, information added to that one of the data units which is transmitted first and representing that the data unit is the first data unit, and information added to each of those ones of the data units which are successively transmitted following the first data unit and representing that the data unit is a following data unit following the first data unit, comprising:

reception means for receiving the data units transmitted on the real time basis;

restoration means for positioning that one of the data units received by said reception means to which the information representing that the data unit is the first data unit as top data is added and positioning each of the data units received following the first data unit to which the information representing that the data unit is a succeeding data unit is added as succeeding data next to the last one of the data units which have been received; and receive data sum total calculation means for calculating the sum total of received data receive by said reception means including data of the data unit to which the information representing that the data unit is the first data unit is added and data of the data units to each of which the information representing that the data unit is a succeeding data unit is added.

15. A reception apparatus according to claim 14, wherein end data representative of the end of transmission of the digital data are transmitted immediately after the last one of the data units of the digital data to be transmitted is transmitted, and further comprising discrimination means for discriminating whether or not the data of any of the data units received by said reception means are the end data.

16. A reception apparatus according to claim 15, wherein the end data include the sum total of the data of the data units transmitted, and further comprising: discrimination means for comparing the sum total of the received data calculated by said receive data sum total calculation means with the sum total of the data of the data units included in the end data to discriminate whether or not all of the digital data transmitted are received normally.

17. A reception apparatus according to claim 14, wherein the digital data to be transmitted are divided into a predetermined number of data units, and said reception apparatus includes counting means for counting the number of the data unit to which the information representing that the data unit is the first data unit is added and the data units to each of which the information representing that the data unit is a following data unit is applied.

18. A reception apparatus according to claim 14, wherein the digital data are text data.

19. A reception apparatus according to claim 14, wherein said reception apparatus can receive main information data in the form of digital data transmitted thereto on the real time basis, and the digital data are duplication control information or copyright information regarding the main information data or ancillary data for allowing said reception apparatus to play back the main information data in accordance with a method or standards determined in advance.

20. A reception apparatus according to claim 14, wherein said reception apparatus can receive main information data in the form of digital data transmitted thereto on the real time basis, and the digital data are ancillary data for allowing said reception apparatus to play back multi-channel digital audio data as the main information data in accordance with a number of channels of said reception apparatus and in accordance with a method or standards determined in advance.

21. A transmission-reception method for transmitting and receiving digital data, which must be transmitted divisionally in a plural number of times and do not admit a miss thereof, on the real time basis, comprising:

a division step performed by a transmission apparatus of dividing the digital data into a predetermined number of units of an equal size;

an information addition step performed by said transmission apparatus of adding, to that one of the transmission data units obtained by the division of the digital data by the division step which is to be transmitted first, information representing that the transmission data unit is the first transmission data unit and adding, to each of those ones of the transmission data units which are to be successively transmitted following the first transmission data unit, information representing that the transmission data unit is a succeeding transmission data unit;

a transmission data sum total calculation step performed by said transmission apparatus of calculating the sum of data in the data units divided by said division means;

a transmission step preformed by said transmission apparatus of transmitting the transmission data units to which the information is added by the information addition step on the real time basis;

a reception step performed by a reception apparatus of receiving the data units transmitted on the real time basis from said transmission apparatus;

a receive data sum total calculation step performed by said reception apparatus of calculating the sum total of received data received by said reception means and including data of the data unit to which the information representing that the data unit is the first data unit is added and data of the data units to each of which the information representing that the data unit is a succeeding data unit is added; and a restoration step performed by said reception apparatus of positioning that one of the data units received by the reception step to which the information representing that the data unit is the first data unit as top data is added and positioning each of the data units received following the first data unit to which the information representing that the data unit is a succeeding data unit is added as succeeding data next to the last one of the data units which have been received till then.

22. A transmission-reception method according to claim 21, further comprising an end data formation step performed by said transmission apparatus of forming end data representative of the end of transmission of the digital data transmitted as the transmission data units, the transmission step transmitting the end data formed by the end data formation step immediately after the last one of the transmission data units of the digital data to be transmitted is transmitted, and a discrimination step performed by said reception apparatus of discriminating whether or not the data of any of the data units received by the reception step are the end data.

23. A transmission-reception method according to claim 22, further comprising: the end data formation step forming the end data which include the sum total calculated by the transmission data sum total calculation step, and a discrimination step executed by said reception apparatus of comparing the sum total of the received data calculated by the receive data sum total calculation step with the sum total of the data of the data units included in the end data to discriminate whether or not all of the digital data transmitted are received normally.

24. A transmission-reception method according to claim 21, wherein the digital data to be transmitted are divided into a predetermined number of data units, and further comprising a counting step performed by said reception apparatus of counting the number of the data unit to which the information representing that the data unit is the first data unit is added and the data units to each of which the information representing that the data unit is a following data unit is applied.

25. A transmission-reception method according to claim 21, wherein the digital data are text data.

26. A transmission-reception method according to claim 21, wherein main information data in the form of digital data can be transmitted between said transmission apparatus and said reception apparatus, and the digital data are duplication control information or copyright information regarding the main information data or ancillary data for allowing said reception apparatus to play back the main information data in accordance with a method or standards determined in advance.

27. A transmission-reception method according to claim 21, wherein main information data in the form of digital data can be transmitted between said transmission apparatus and said reception apparatus, and the digital data are ancillary data for allowing said reception apparatus to play back multi-channel digital audio data as the main information data in accordance with a number of channels of said reception apparatus and in accordance with a method or standards determined in advance.

* * * * *